US011040536B2

(12) United States Patent
Yoneta et al.

(10) Patent No.: US 11,040,536 B2
(45) Date of Patent: Jun. 22, 2021

(54) LIQUID DISCHARGE HEAD, LIQUID DISCHARGE DEVICE, AND LIQUID DISCHARGE APPARATUS

(71) Applicant: Ricoh Company, Ltd., Tokyo (JP)

(72) Inventors: Ryohta Yoneta, Kanagawa (JP); Takahiro Yoshida, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/676,671

(22) Filed: Nov. 7, 2019

(65) Prior Publication Data

US 2020/0164644 A1 May 28, 2020

(30) Foreign Application Priority Data

Nov. 28, 2018 (JP) ..... JP2018-222132
Mar. 6, 2019 (JP) ..... JP2019-040741

(51) Int. Cl.
*B41J 2/14* (2006.01)

(52) U.S. Cl.
CPC ..... *B41J 2/1433* (2013.01)

(58) Field of Classification Search
CPC ..... B41J 2/1433; B41J 2002/14419; B41J 2002/14459; B41J 2002/14362; B41J 2202/12; B41J 2202/20; B41J 2202/21; B41J 2/14274; B41J 2/14233
See application file for complete search history.

(56) References Cited

U.S. PATENT DOCUMENTS

| | | | |
|---|---|---|---|
| 2015/0077471 A1 | 3/2015 | Yoneta | |
| 2017/0087865 A1 | 3/2017 | Yoshida et al. | |
| 2017/0239949 A1 | 8/2017 | Yoshida | |
| 2018/0072066 A1 | 3/2018 | Yoneta | |
| 2018/0257386 A1* | 9/2018 | Asaka | B41J 2/18 |
| 2019/0084313 A1 | 3/2019 | Kohda et al. | |

FOREIGN PATENT DOCUMENTS

| | | |
|---|---|---|
| JP | 2004-358737 | 12/2004 |
| JP | 2011-079251 | 4/2011 |
| JP | 2013-063366 | 4/2013 |
| JP | 2017-149018 | 8/2017 |
| JP | 2018-099857 | 6/2018 |

* cited by examiner

*Primary Examiner* — Sharon Polk
(74) *Attorney, Agent, or Firm* — Harness, Dickey & Pierce, P.L.C.

(57) ABSTRACT

A liquid discharge head includes a plurality of nozzles from which a liquid is discharged in a gravity direction, a plurality of pressure chambers communicating with the plurality of nozzles, respectively, a common channel communicating with each of the plurality of pressure chambers, the common channel including a top surface and a bottom surface disposed below the top surface in the gravity direction, and a plurality of convex portions formed on the bottom surface of the common channel.

20 Claims, 22 Drawing Sheets

LIQUID DISCHARGE HEAD, LIQUID DISCHARGE DEVICE, AND LIQUID DISCHARGE APPARATUS

CROSS-REFERENCE TO RELATED APPLICATIONS

This patent application is based on and claims priority pursuant to 35 U.S.C. § 119(a) to Japanese Patent Application No. 2018-222132, filed on Nov. 28, 2018 in the Japan Patent Office and Japanese Patent Application No. 2019-040741, filed on Mar. 6, 2019 in the Japan Patent Office, the entire disclosures of which are hereby incorporated by reference herein.

BACKGROUND

Technical Field

Aspects of the present disclosure relate to a liquid discharge head, a liquid discharge device, and a liquid discharge apparatus.

Related Art

A liquid discharge head that discharges a liquid includes a common channel (common chamber) that communicates with a plurality of individual chambers (pressure chambers).

The liquid discharge head includes a plurality of partitions on a top surface opposite a bottom surface of the common chamber when a discharge direction of the liquid is toward the gravity direction, and the bottom surface is disposed lower side in the gravity direction.

SUMMARY

In an aspect of this disclosure, a liquid discharge head includes a plurality of nozzles from which a liquid is discharged in a gravity direction, a plurality of pressure chambers communicating with the plurality of nozzles, respectively, a common channel communicating with each of the plurality of pressure chambers, the common channel including a top surface and a bottom surface disposed below the top surface in the gravity direction, and a plurality of convex portions formed on the bottom surface of the common channel.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
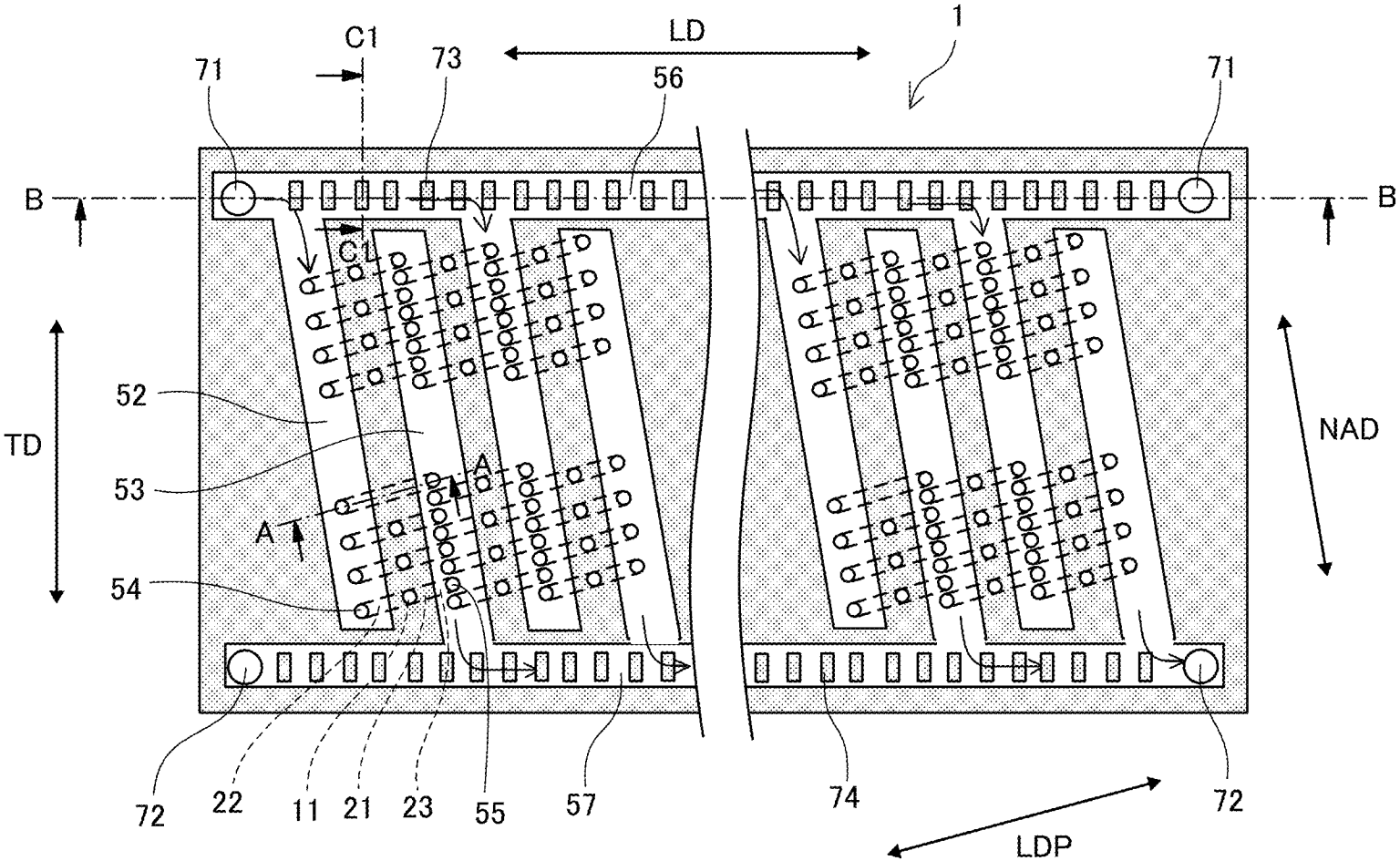
FIG. 1 is a plan view of a liquid discharge head according to a first embodiment of the present disclosure illustrating a channel arrangement and configuration of the liquid discharge head.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a", "an", and "the" are intended to include the plural forms as well, unless the context clearly indicates otherwise.

Hereinafter, embodiments of the present disclosure are described with reference to the attached drawings. A liquid discharge head according to an embodiment of the present disclosure is described with reference to FIGS. 1 through 3.

Figure 2:
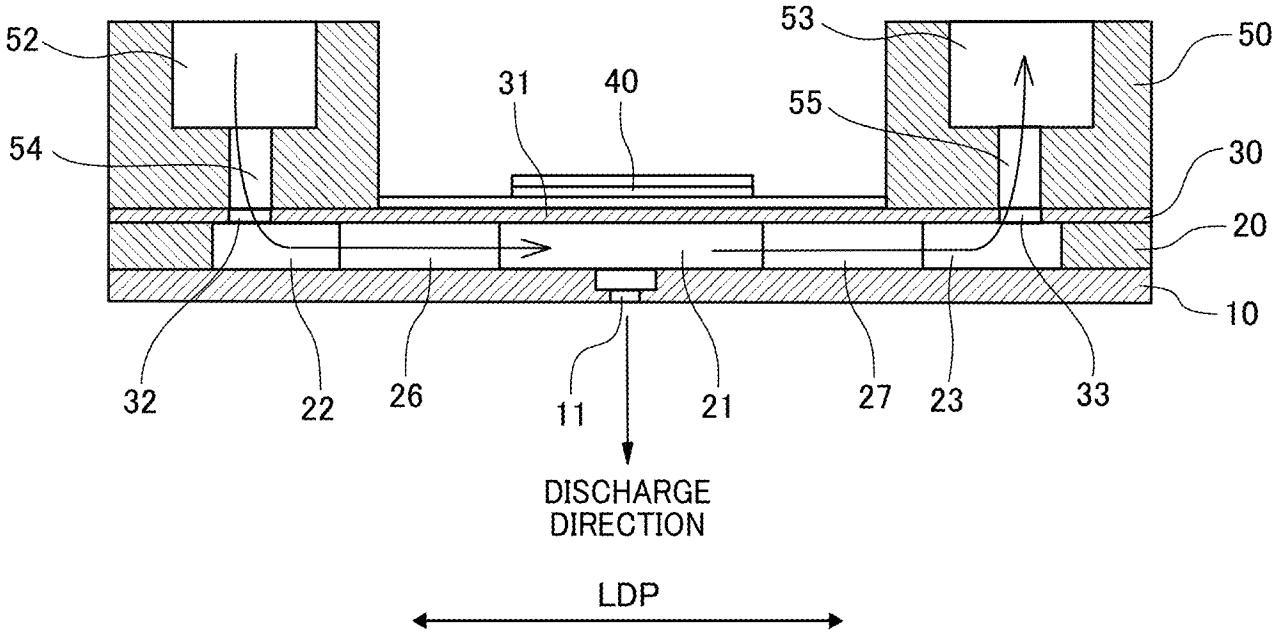
FIG. 2 is a cross-sectional view of the liquid discharge head along a line A-A of FIG. 1.

In the following, embodiments of the present disclosure is described with reference to the accompanying drawings. Next, a first embodiment of the present disclosure is described with reference to FIGS. 1 and 2. FIG. 1 is a plan view of a liquid discharge head according to the first embodiment of the present disclosure. FIG. 2 is a cross-sectional view of the liquid discharge head 1 along a line A-A of FIG. 1.

The liquid discharge head 1 includes a nozzle plate 10, an individual channel member 20 (channel plate), a diaphragm member 30, a piezoelectric element 40, a common channel member 50, and the like. Hereinafter, the liquid discharge head 1 is simply referred to as the "head 1".

The nozzle plate 10 includes a plurality of nozzles 11 to discharge a liquid. The plurality of nozzles 11 are arranged in a two-dimensional matrix.

The individual channel member 20 includes a plurality of pressure chambers 21 (individual chambers) respectively communicating with the plurality of nozzles 11, a plurality of individual-supply channels 22 respectively communicating with the plurality of pressure chambers 21, and a plurality of individual-recovery channels 23 respectively communicating with the plurality of pressure chambers 21. The individual-supply channel 22 includes a supply-side fluid restrictor 26, and the individual-recovery channel 23 includes a recovery-side fluid restrictor 27.

The diaphragm member 30 forms a diaphragm 31 serving as a deformable wall of the pressure chamber 21, and the piezoelectric element 40 is formed on the diaphragm 31 to form a single body. Further, the diaphragm member 30 includes a supply opening 32 communicating with the individual-supply channel 22 and a recovery opening 33 communicating with the individual-recovery channel 23. The piezoelectric element 40 is a pressure generator to deform the diaphragm 31 to pressurize the liquid in the pressure chamber 21.

The common channel member 50 includes a plurality of common-supply branch channels 52 that communicate with two or more individual-supply channels 22 and a plurality of common-recovery branch channels 53 that communicate with two or more individual-recovery channels 23. The plurality of common-supply branch channels 52 and the plurality of common-recovery branch channels 53 are arranged alternately adjacent to each other.

The common channel member 50 includes a supply port 54 and a recovery port 55. The supply port 54 connects the supply opening 32 of the individual-supply channel 22 and the common-supply branch channel 52. The recovery port 55 connects the recovery opening 33 of the individual-recovery channel 23 and the common-recovery branch channel 53.

The common channel member 50 includes one or more common-supply main channels 56 (see FIG. 1) that communicate with the plurality of common-supply branch channels 52, and one or more common-recovery main channels 57 (see FIG. 1) that communicate with the plurality of common-recovery branch channels 53. The common-supply main channel 56 includes supply ports 71 connected to an external circulation device, and the common-recovery main channel 57 includes recovery ports 72 connected to the external circulation device.

The common-supply main channel 56, the common-supply branch channels 52, the common-recovery main channels 57, and the common-recovery branch channels 53 are collectively referred to as a "common channel".

The common-supply main channel 56 and the plurality of common-supply branch channels 52 form a common-supply channel. The common-recovery main channel 57 and the plurality of common-recovery branch channels 53 form a common-recovery channel. The common-supply channel and the common-recovery channel form the common channel.

Figure 3:
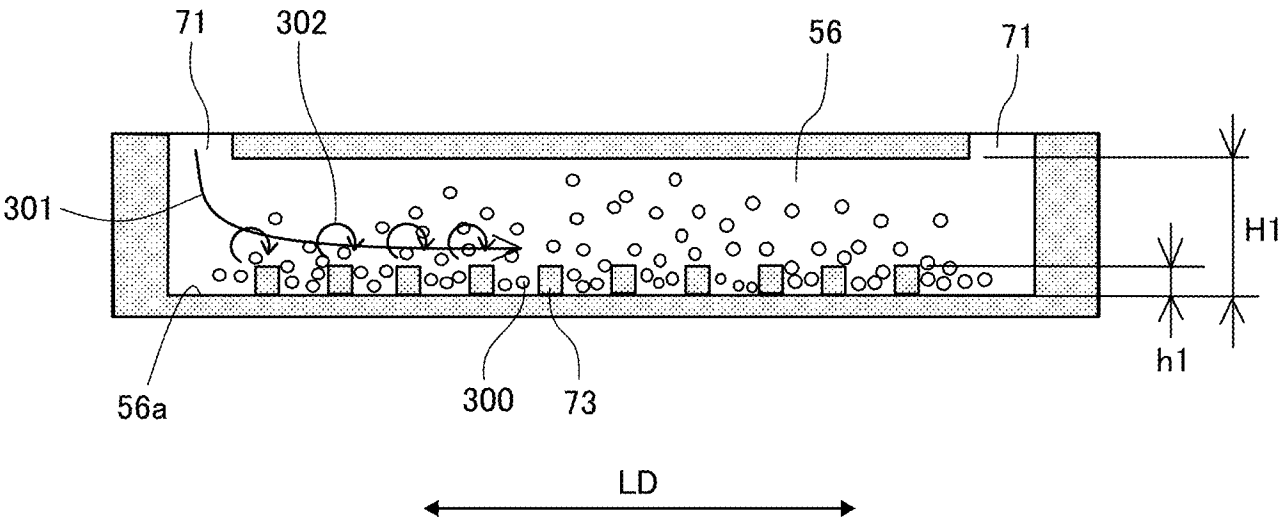
FIG. 3 is a cross-sectional view of a common-supply main channel in a longitudinal direction of the common-supply main channel along a line B-B in FIG. 1.
Figure 4:
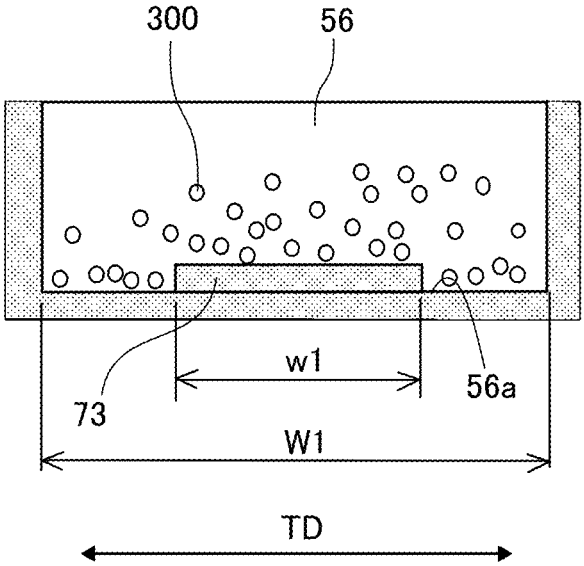
FIG. 4 is a cross-sectional view of the common-supply main channel in a transverse direction of the common-supply main channel along a line C1-C1 in FIG. 1.

Next, a configuration of the common channel in the first embodiment is described with reference to FIGS. 3 and 4. FIG. 3 is a cross-sectional view of the common-supply main channel 56 in a longitudinal direction of the common-supply main channel 56 along a line B-B in FIG. 1. The longitudinal direction of the common-supply main channel 56 is indicated by arrow "LD" in FIGS. 1, 3, and 4. Also, a longitudinal direction of the pressure chamber 21 is indicated by arrow "LDP" in FIGS. 1 and 2. Further, a nozzle array direction along which the plurality of nozzles are arrayed is indicated by arrow "NAD" in FIG. 1. FIG. 4 is a cross-sectional view of the common-supply main channel 56 in a transverse direction of the common-supply main channel 56 along a line C1-C1 in FIG. 1. FIGS. 3 and 4 illustrate an operation of a liquid flow in the common-supply main channel 56.

The head 1 according to the present disclosure includes a plurality of convex portions 73 on a bottom surface 56*a* of the common-supply main channel 56. Here, the bottom surface 56*a* is a surface of a wall of the common-supply main channel 56 disposed at lower side in a gravity direction as illustrated in FIGS. 3 and 4 when a discharge direction of the liquid from the nozzle 11 is in the gravity direciton (directed downward) as illustrated in FIG. 2.

Here, the "gravity direction" is not limited to a direction along the gravity direction, but includes a direction having an inclination of less than 45° with respect to the gravity direction (an obliquely downward direction).

Here, the convex portions 73 are arranged in a central part in a transverse direction (width direction) of the common-supply main channel 56 as illustrated in FIG. 4. The transverse direciton of the common-supply main channel 56 is indicated by arrow "TD" in FIGS. 1, 3, and 4. The transverse direction TD is perpendicular to the longitudinal direction LD.

The convex portions 73 in the common-supply main channel 56 thus configured generate a difference in the flow rate of a liquid flowing through the common-supply main channel 56 when the liquid is supplied from the supply port 71 and flows through the common-supply main channel 56 in a direction as indicated by arrow 301 in FIG. 3. The difference in the flow rate generates vortexes 302 (including turbulence of flow of the liquid) in the common-supply main channel 56.

Thus, the liquid containing sedimentation components 300 is efficiently stirred in the common-supply main channel 56, and the sedimentation components 300 are rolled up. Thus, the convex portions 73 can prevent sedimentation of the sedimentation components 300 in the common-supply main channel 56.

The common-supply main channel 56 includes both of a region with the convex portion 73 and a region without the convex portion 73 to generate the vortexes 302. As illustrated in FIG. 4, a width w1 of the convex portion 73 is preferably equal to or less than half of a channel width W1 of the common-supply main channel 56 in a transverse direction TD of the common-supply main channel 56.

Further, as illustrated in FIG. 3, if a height h1 of the convex portion 73 is too high, an efficiency of stirring the sedimentation component is reduced. Thus, a height h1 of the convex portion 73 is preferably equal to or less than half of a channel height H1 of the common-supply main channel 56.

The convex portions 73 may be formed by etching or the like. Further, although the convex portions 73 in FIGS. 3 and 4 have a rectangular shape, the convex portions 73 may have a rectangular shape, a trapezoid shape, semicircular shape, semi-elliptical shape, and the like.

Further, the head 1 in the present disclosure includes convex portions 74 in the common-recovery main channel 57 as in the convex portions 73 in the common-supply main channel 56 as illustrated in FIG. 1. The arrangement, configuration, and the like of the convex portions 74 are the same as the arrangement, configuration, and the like of the convex portions 73. Thus, the convex portions 74 can prevent sedimentation of the sedimentation component 300 contained in the liquid in the common-recovery main channel 57.

Figure 5:
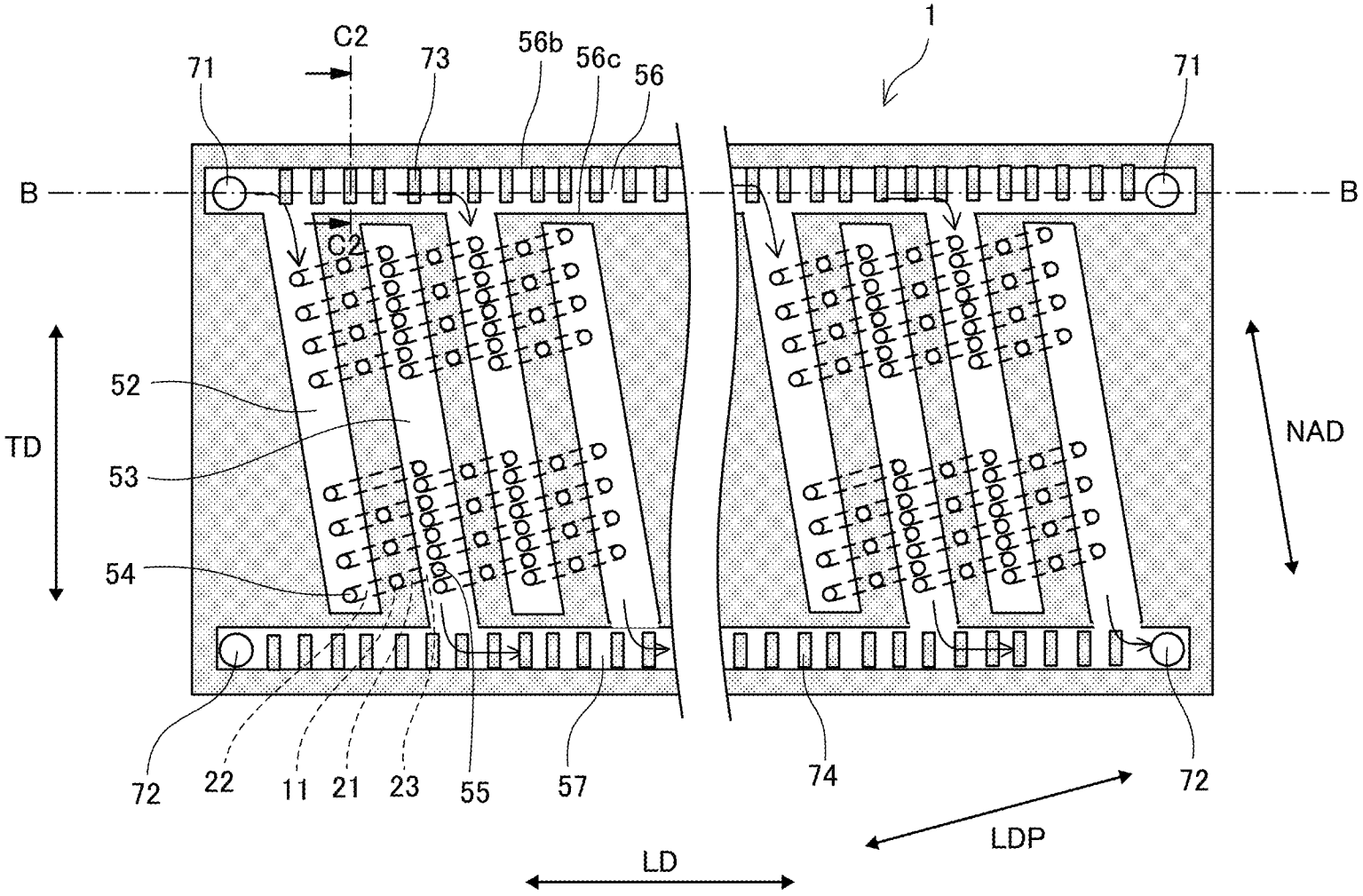
FIG. 5 is a plan view of the liquid discharge head according to a second embodiment of the present disclosure illustrating a channel arrangement and configuration of the liquid discharge head.
Figure 6:
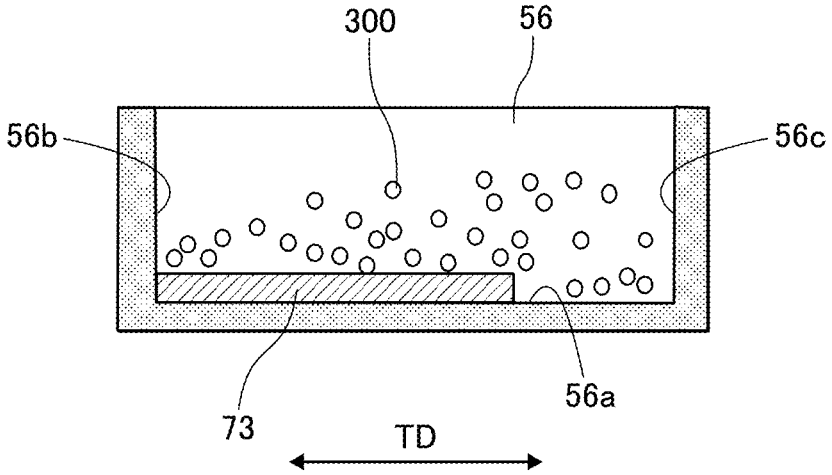
FIG. 6 is a cross-sectional view of the common-supply main channel in the transverse direction of the common-supply main channel along a line C2-C2 in FIG. 5.

A second embodiment of the present disclosure is described with reference to FIGS. 5 and 6. FIG. 5 is a plan view of the head 1 according to the second embodiment illustrating a channel arrangement and configuration of the head 1. FIG. 6 is a cross-sectional view of the head 1 along a line C2-C2 of FIG. 5. The cross-sectional view along the line B-B of the head 1 in FIG. 5 is the same as the cross-sectional view of the head 1 in FIG. 3.

The convex portions 73 in the second embodiment formed on the bottom surface 56*a* of the common-supply main channel 56 is arranged to be biased toward one side of a first side wall 56*b* (see FIG. 6) in the transverse direction TD of the common-supply main channel 56. Specifically, one end (left end in FIG. 6) of each of the convex portions 73 contacts the first side wall 56*b* of the common-supply main channel 56, and another end of each of the convex portions 73 does not contact (has a space with) a second side wall 56*c* disposed opposite the first side wall 56*b* in the transverse direction TD.

Thus, one end of each of the plurality of convex portions 73 contacts the first side wall 56*b* of the common-supply main channel 56 in a transverse direction TD of the common-supply main channel 56. Another end of each of the plurality of convex portions 73 separates from the second side wall 56*c* disposed opposite the first side wall 56*b*, and the second side wall 56*c* is connected to each of the plurality of common-supply branch channels 52.

The first side wall 56*b* to which the convex portions 73 contact (biased) is opposite the second side wall 56*c* to which the common-supply branch channels 52 are connected in the transverse direction TD. The convex portions 73 may be formed together with the first side wall 56*b* and the bottom surface 56*a* as a single body.

As in the first embodiment, the convex portions 73 in the common-supply main channel 56 thus configured generate a difference in the flow rate of a liquid flowing through the common-supply main channel 56 when the liquid is supplied from the supply port 71 and flows through the common-supply main channel 56 in a direction as indicated by arrow 301 in FIG. 3. The difference in the flow rate generates vortexes 302 (including turbulence of flow of the liquid) in the common-supply main channel 56.

Thus, the liquid containing sedimentation components 300 is efficiently stirred in the common-supply main channel 56, and the sedimentation components 300 are rolled up. Thus, the convex portions 73 can prevent sedimentation of the sedimentation components 300 in the common-supply main channel 56.

Further, the head 1 in the present disclosure includes the convex portions 74 in the common-recovery main channel 57 as in the convex portions 73 in the common-supply main channel 56 as illustrated in FIG. 5. The arrangement, configuration, and the like of the convex portions 74 are the same as the arrangement, configuration, and the like of the convex portions 73. Thus, the convex portions 74 can prevent sedimentation of the sedimentation component 300 contained in the liquid in the common-recovery main channel 57.

Figure 7:
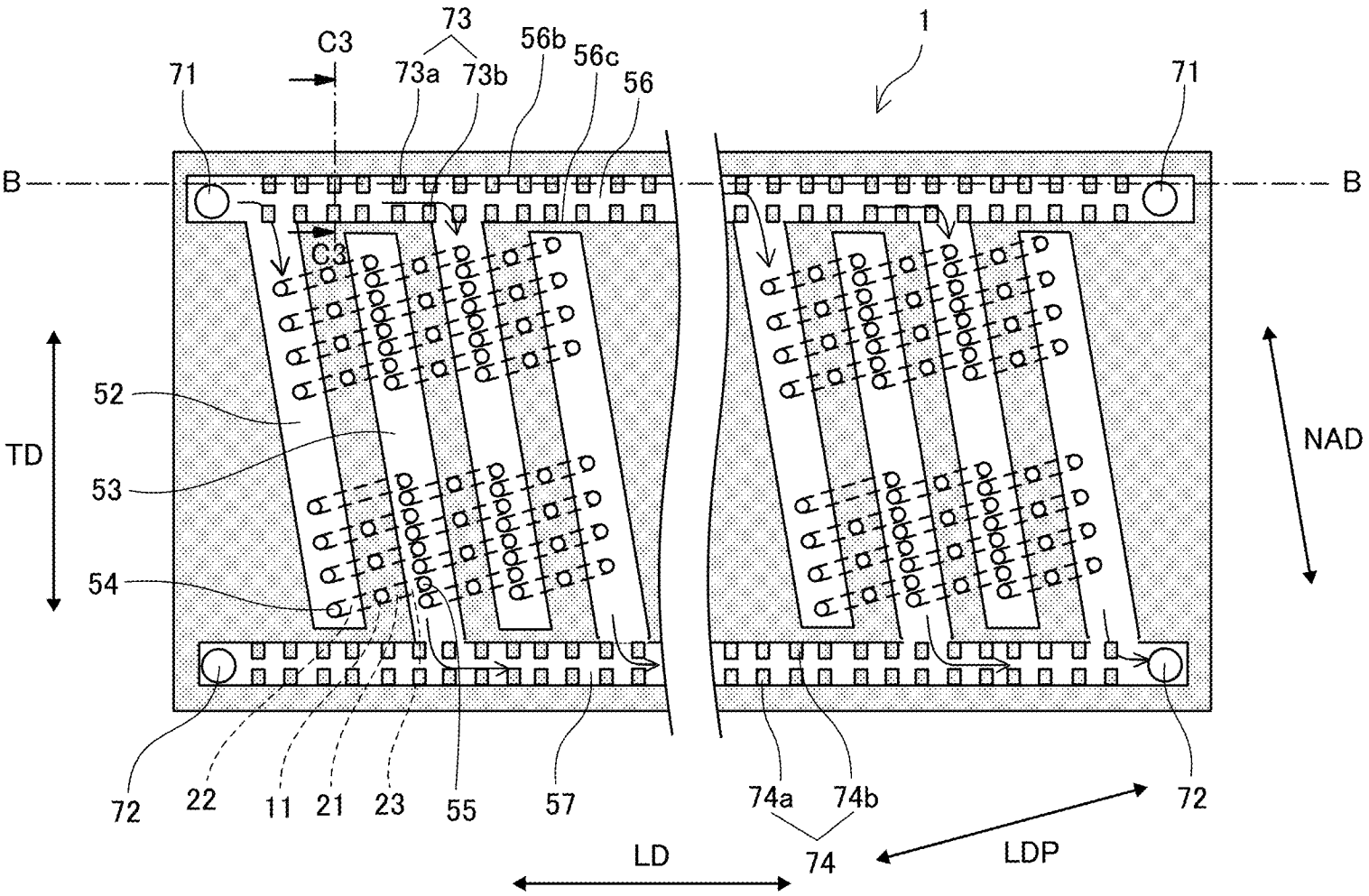
FIG. 7 is a plan view of the liquid discharge head according to a third embodiment of the present disclosure illustrating a channel arrangement and configuration of the liquid discharge head.
Figure 8:
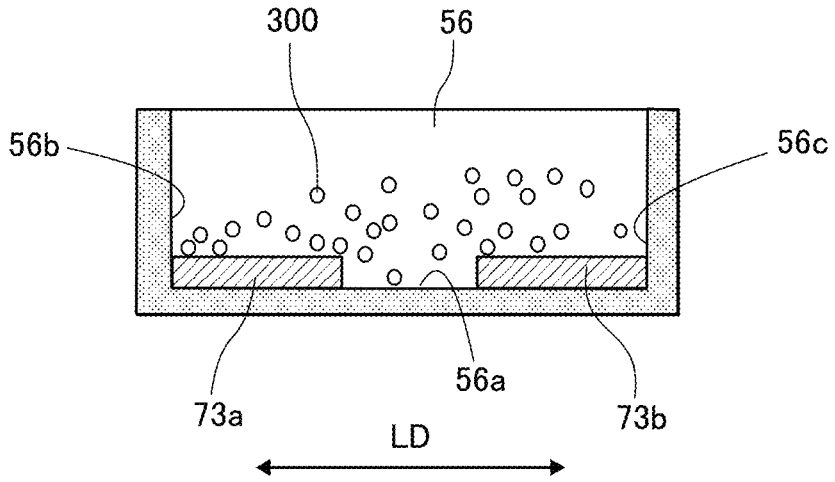
FIG. 8 is a cross-sectional view of the common-supply main channel in the transverse direction of the common-supply main channel along a line C3-C3 in FIG. 7.

A third embodiment of the present disclosure is described with reference to FIGS. 7 and 8. FIG. 7 is a plan view of the head 1 according to the third embodiment illustrating a channel arrangement and configuration of the head 1. FIG. 8 is a cross-sectional view of the head 1 along a line C3-C3 of FIG. 7. The cross-sectional view along the line B-B of the head 1 in FIG. 7 is the same as the cross-sectional view of the head 1 in FIG. 3.

The convex portions 73 in the third embodiment formed on the bottom surface 56*a* of the common-supply main channel 56 is arranged to be biased toward each of the first side wall 56*b* and the second side wall 56*c* (see FIGS. 7 and 8) in the transverse direction TD of the common-supply main channel 56. Specifically, each of the convex portions 73 is divided into two parts (first part 73*a* and second part 73*b*). A first part 73*a* of the convex portion 73 contacts the first side wall 56*b*, a second part 73*b* of the convex portion 73 contacts the second side wall 56*c*, and there is a space between the first part 73*a* and the second part 73*b* of the convex portion 73 in a center of the bottom surface 56*a* in the transverse direction TD of the common-supply main channel 56.

Thus, each of the plurality of convex portions 73 includes a first part 73*a* contacting the first side wall 56*b* of the common-supply main channel 56 in a transverse direction TD of the common-supply main channel 56, and a second part 73*b* contacting a second side wall 56*c* of the common-supply main channel 56 opposite the first side wall 56*b* with a space between the first part 73*a*.

As in the first embodiment, the convex portions 73 (first part 73*a* and second part 73*b*) in the common-supply main channel 56 thus configured generate a difference in the flow rate of a liquid flowing through the common-supply main channel 56 when the liquid is supplied from the supply port 71 and flows through the common-supply main channel 56 in the direction as indicated by arrow 301 in FIG. 3. The difference in the flow rate generates vortexes 302 (including turbulence of flow of the liquid) in the common-supply main channel 56.

Thus, the liquid containing sedimentation components 300 is efficiently stirred in the common-supply main channel 56, and the sedimentation components 300 are rolled up. Thus, the convex portions 73 can prevent sedimentation of the sedimentation components 300 in the common-supply main channel 56.

Further, the head 1 in the present disclosure includes the convex portions 74 (first part 74*a* and second part 74*b*) in the common-recovery main channel 57 as in the convex portions 73 (first part 73*a* and second part 73*b*) in the common-supply main channel 56 as illustrated in FIG. 7. The arrangement, configuration, and the like of the convex portions 74 (first part 74*a* and second part 74*b*) are the same as the arrangement, configuration, and the like of the convex portions 73 (first part 73*a* and second part 73*b*). Thus, the convex portions 74 (first part 74*a* and second part 74*b*) can prevent sedimentation of the sedimentation component 300 contained in the liquid in the common-recovery main channel 57.

Figure 9:
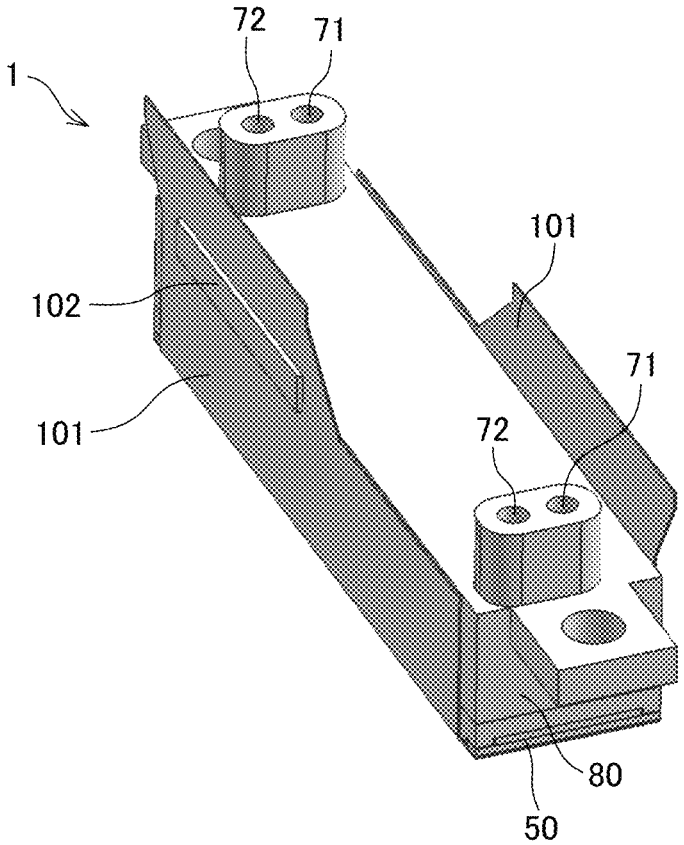
FIG. 9 is an outer perspective view of the liquid discharge head according to a fourth embodiment of the present disclosure.
Figure 10:
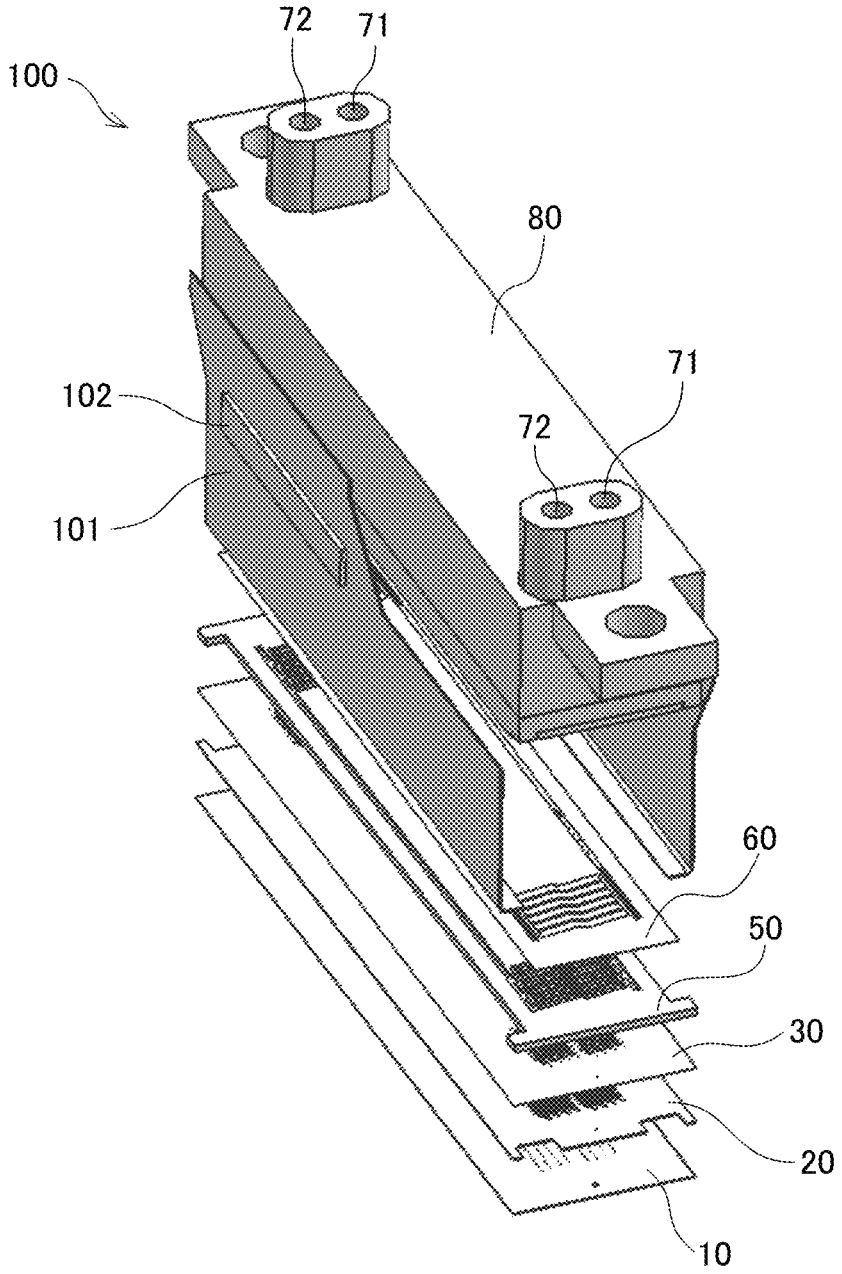
FIG. 10 is an exploded perspective view of the liquid discharge head in the fourth embodiment.
Figure 11:
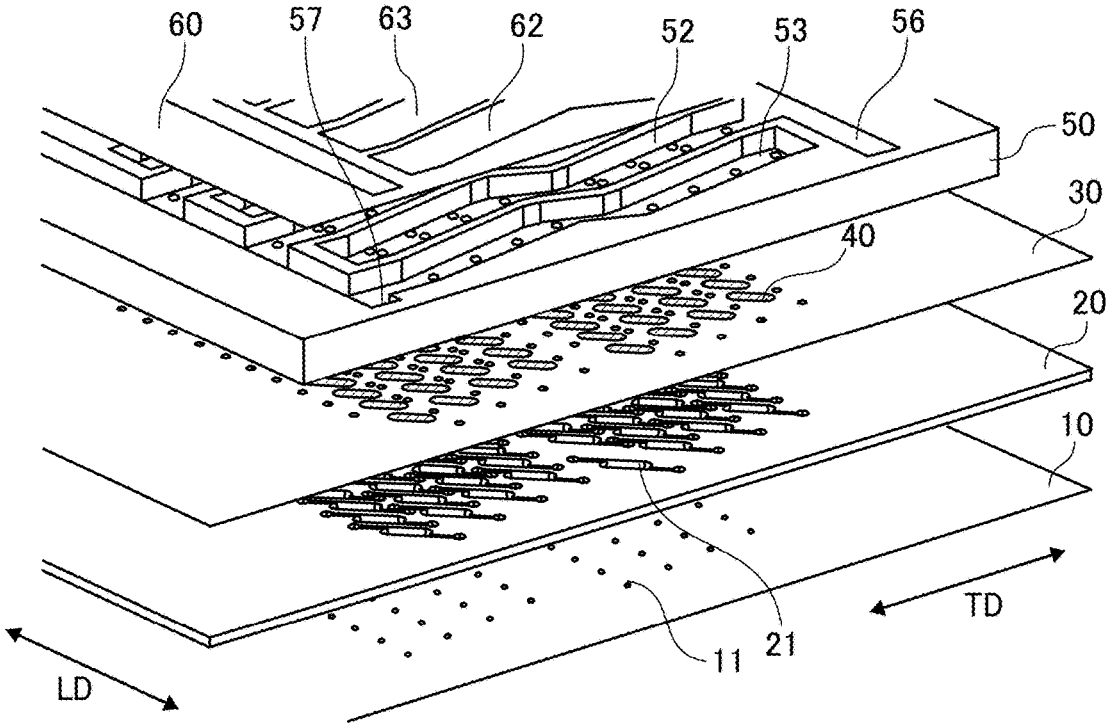
FIG. 11 is an exploded perspective view of the liquid discharge head without a frame in the fourth embodiment.
Figure 12:
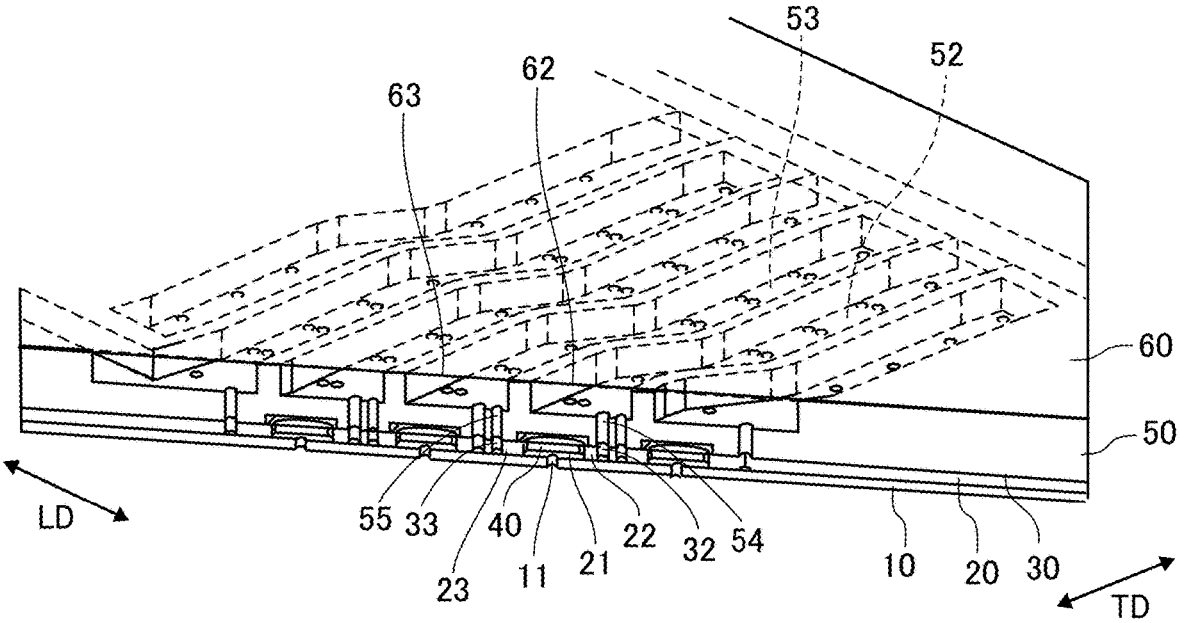
FIG. 12 is a cross-sectional perspective view of channels in the liquid discharge head in the fourth embodiment.
Figure 13:
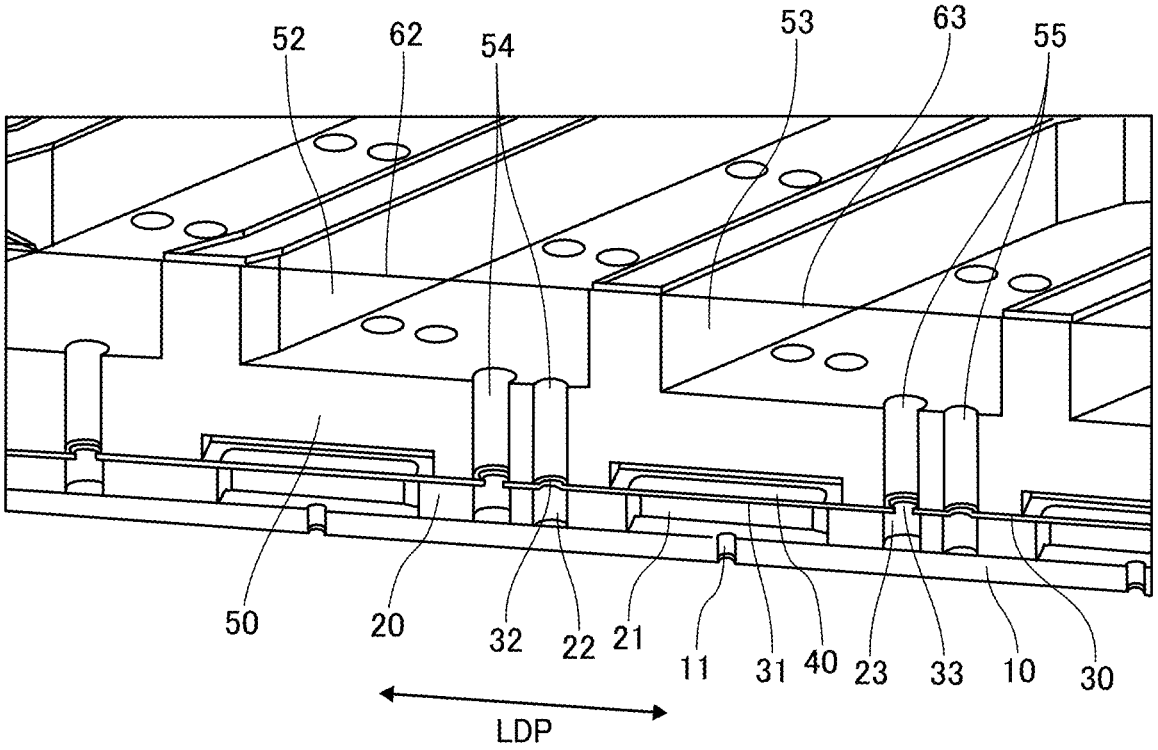
FIG. 13 is an enlarged cross-sectional perspective view of the channels in the fourth embodiment.

Next, a fourth embodiment of the present disclosure is described with reference to FIGS. 9 to 13. FIG. 9 is an outer perspective view of the head 1 according to the fourth embodiment. FIG. 10 is an exploded perspective view of the head 1. FIG. 11 is an exploded perspective view of the head 1 excluding a frame. FIG. 12 is a cross-sectional perspective view of channels of the head 1. FIG. 13 is an enlarged cross-sectional perspective view of the channels of the head 1.

The head 1 includes a nozzle plate 10, an individual channel member 20 (channel plate), a diaphragm member 30, a common channel member 50, a damper 60, a frame 80, and a flexible wiring 101 (substrate) mounting a drive circuit 102.

The nozzle plate 10 includes a plurality of nozzles 11 to discharge a liquid. The plurality of nozzles 11 are arranged in a two-dimensional matrix.

The individual channel member 20 includes a plurality of pressure chambers 21 (individual chambers) respectively communicating with the plurality of nozzles 11, a plurality of individual-supply channels 22 respectively communicating with the plurality of pressure chambers 21, and a plurality of individual-recovery channels 23 respectively communicating with the plurality of pressure chambers 21. A combination of one pressure chamber 21, one individual-supply channel 22 communicating with one pressure chamber 21, and one individual-recovery channel 23 communicating with one pressure chamber 21 is collectively referred to as an individual channel.

The diaphragm member 30 forms a diaphragm 31 serving as a deformable wall of the pressure chamber 21, and the piezoelectric element 40 is formed on the diaphragm 31 to form a single body. Further, the diaphragm member 30 includes a supply opening 32 communicating with the individual-supply channel 22 and a recovery opening 33 communicating with the individual-recovery channel 23. The piezoelectric element 40 is pressure generating means (driving element) that deforms the diaphragm 31 to pressurize the liquid in the pressure chamber 21.

The common channel member 50 includes a plurality of common-supply branch channels 52 that communicate with two or more individual-supply channels 22 and a plurality of common-recovery branch channels 53 that communicate with two or more individual-recovery channels 23. The plurality of common-supply branch channel 52 and the plurality of common-recovery branch channel 53 are alternately formed adjacent to each other in the longitudinal direction LD of the common-supply main channel 56 (see FIGS. 11 and 12).

As illustrated in FIGS. 12 and 13, the common channel member 50 includes a through hole serving as a supply port 54 that connects the supply opening 32 of the individual-supply channel 22 and the common-supply branch channel 52 and a through hole serving as a recovery port 55 that connects the recovery opening 33 of the individual-recovery channel 23 and the common-recovery branch channel 53.

The common channel member 50 includes one or more common-supply main channels 56 (see FIG. 1) that communicate with the plurality of common-supply branch channels 52, and one or more common-recovery main channels 57 (see FIG. 1) that communicate with the plurality of common-recovery branch channels 53.

As illustrated in FIG. 11, the damper 60 includes a supply-side damper 62 that faces (opposes) the supply port 54 of the common-supply branch channel 52 and a recovery-side damper 63 that faces (opposes) the recovery port 55 of the common-recovery branch channel 53.

As illustrated in FIGS. 11 to 13, the common-supply branch channel 52 and the common-recovery branch channel 53 are formed by sealing grooves with the supply-side damper 62 and the recovery-side damper 63 of the damper 60. The grooves are alternately arranged in the common channel member 50 in the longitudinal direction LD of the common-supply main channel 56. Both of the common-supply branch channel 52 and the common-recovery branch channel 53 are formed in the same common channel member 50.

The head 1 in the fourth embodiment also includes the convex portions 73 and 74 on the bottom surface 56*a* of the common-supply main channel 56 and the common-recovery main channel 57 in the same manner as in the first to third embodiments. Thus, the convex portions 73 and 74 can prevent sedimentation of the sedimentation component 300 contained in the liquid in the common-supply main channel 56 and the common-recovery main channel 57.

Figure 14:
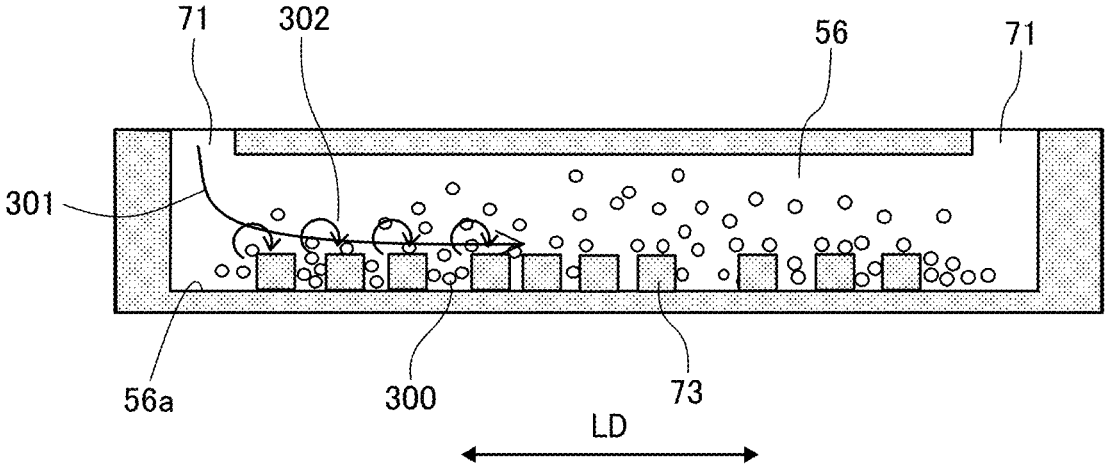
FIG. 14 is a cross-sectional view of the common-supply main channel of the liquid discharge head according to a fifth embodiment of the present disclosure in the longitudinal direction of the common-supply main channel.

A fifth embodiment of the present disclosure is described with reference to FIG. 14. FIG. 14 is a cross-sectional view of the common-supply main channel 56 of the head 1 according to the fifth embodiment in the longitudinal direction LD of the common-supply main channel 56.

The head 1 according to the fifth embodiment includes the convex portions 73 in the common-supply main channel 56. A density of arrangement of the convex portions 73 in a portion away from the supply ports 71 is larger than a density of arrangement of the convex portions 73 in a portion near the supply ports 71 in the common-supply main channel 56.

In FIG. 14, the supply ports 71 are connected to each ends of the common-supply main channel 56 in the transverse direction TD of the common-supply main channel 56. A density of arrangement of the convex portions 73 arranged at a central portion of the common-supply main channel 56 in the transverse direction TD is made larger than a density of arrangement of the convex portions 73 arranged at an end portions of the common-supply main channel 56 in the transverse direction TD. Reducing an arrangement pitch between adjacent convex portions 73 or increasing the number of the convex portions 73 can increase the density of arrangement of the convex portions 73 at the central portion of the common-supply main channel 56 in the transverse direction TD.

Thus, the convex portions 73 can effectively stir the liquid on a downstream side of the supply port 71 at which an amount of flow of the liquid decreases.

Figure 15:
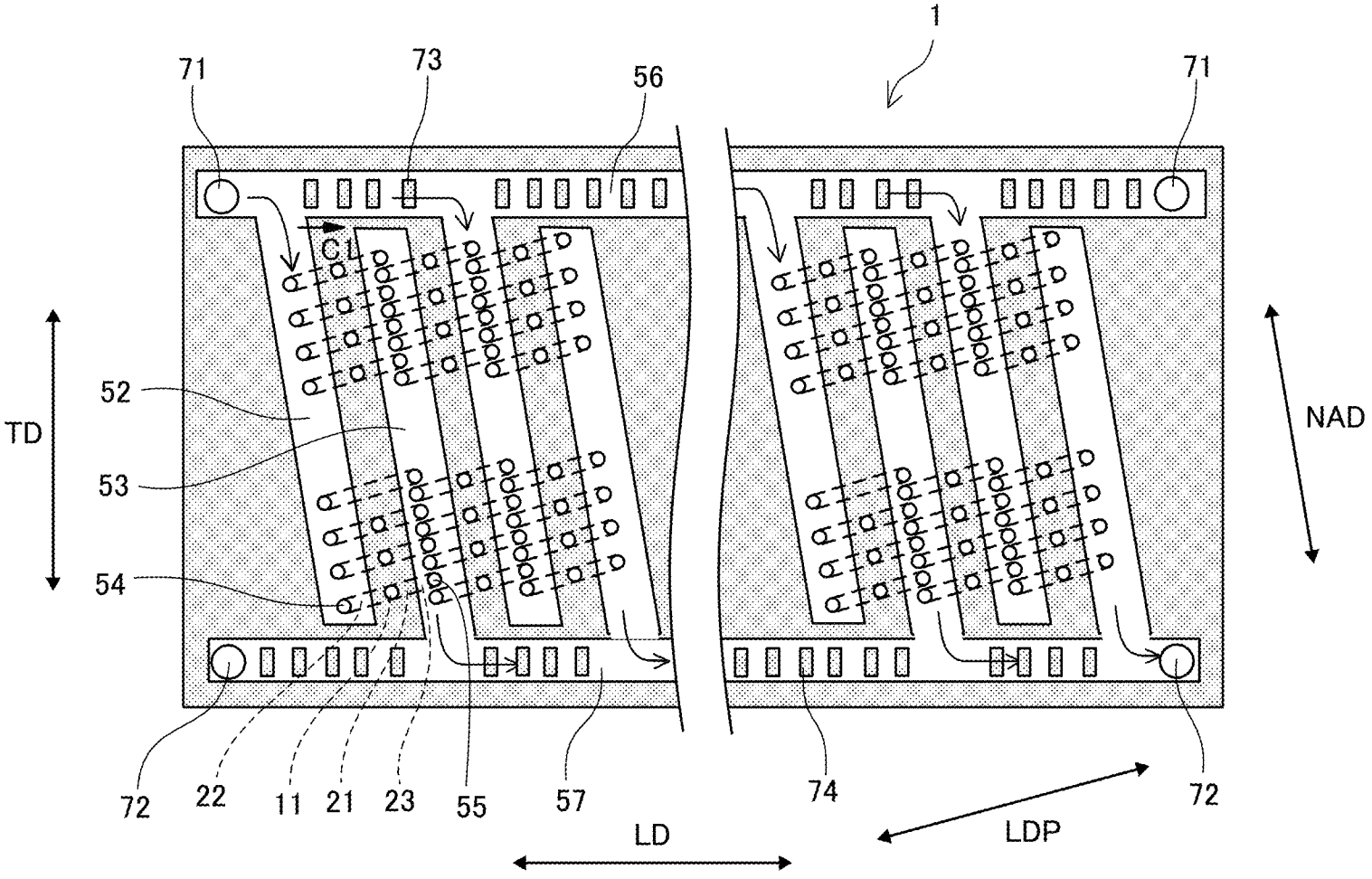
FIG. 15 is a plan view of the liquid discharge head according to a sixth embodiment of the present disclosure illustrating a channel arrangement and configuration of the liquid discharge head.

A sixth embodiment of the present disclosure is described with reference to FIG. 15. FIG. 15 is a plan view of the head 1 according to the sixth embodiment illustrating a channel arrangement and configuration of the head 1.

The head 1 according to the sixth embodiment does not include the convex portions 73 at connection portions between the common-supply branch channels 52 and the common-supply main channel 56. Conversely, the head 1 includes the convex portion 73 at portions other than the connection portions in the common-supply main channel 56.

Thus, the common-supply main channel 56 includes the plurality of convex portions 73 at portions between connections at which the common-supply main channel 56 is connected to the plurality of common-supply branch channels 52.

Similarly, the head 1 according to the sixth embodiment does not include the convex portions 74 at connection portions between the common-recovery branch channels 53 and the common-recovery main channel 57. Conversely, the head 1 includes the convex portion 74 at portions other than the connection portions in the common-recovery main channel 57.

Thus, the common-recovery main channel 57 includes the plurality of convex portions 74 at portions between connections at which the common-recovery main channel 57 is connected to the plurality of common-recovery branch channels 53.

Thus, the convex portions 73 do not hinder a liquid flow (liquid supply) from the common-supply main channel 56 to the common-supply branch channel 52. Further, the convex portions 74 do not hinder a liquid flow (liquid supply) from the common-recovery branch channel 53 to the common-supply main channel 57.

Figure 16:
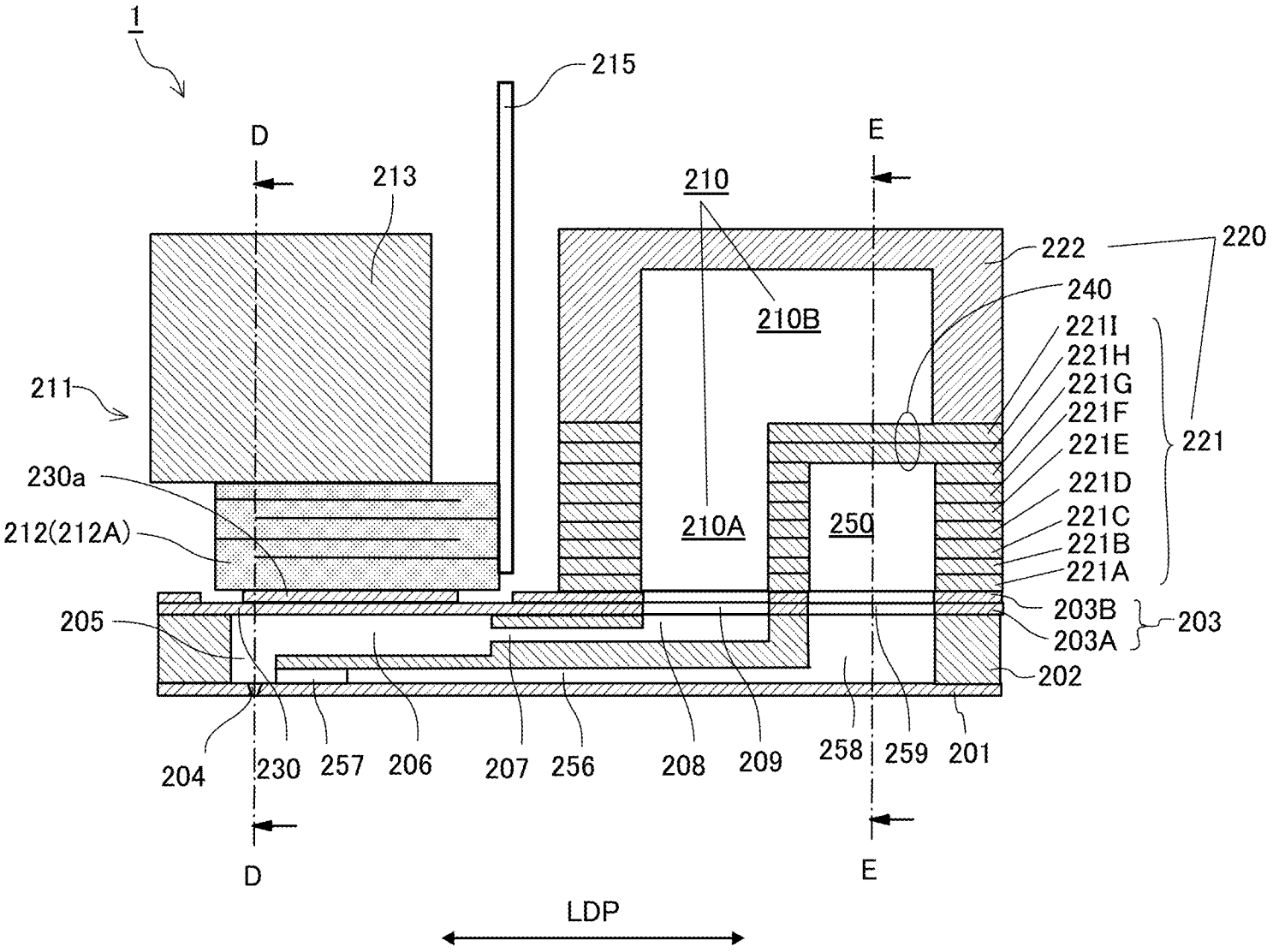
FIG. 16 is a cross-sectional view of the liquid discharge head according to the sixth embodiment of the present disclosure in a nozzle array direction of the liquid discharge head.
Figure 17:
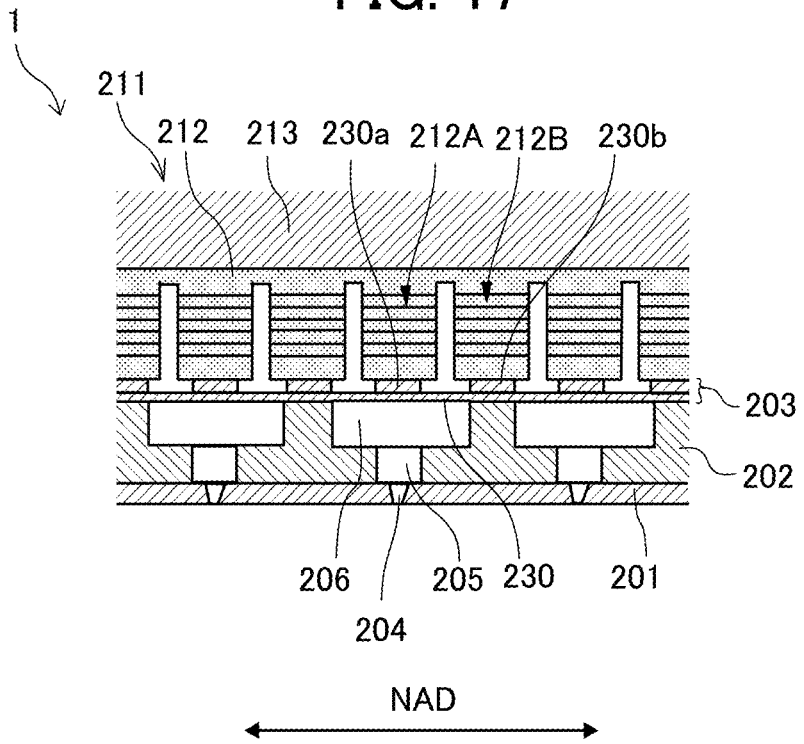
FIG. 17 is a cross-sectional view of the liquid discharge head along the nozzle array direction corresponding to a line D-D in FIG. 16.

A seventh embodiment of the present disclosure is described with reference to FIGS. 16 and 17. FIG. 16 is a cross-sectional view of the head 1 according to the seventh embodiment along a longitudinal direction of a pressure chamber 206 indicated by arrow "LDP" in FIG. 16. The longitudinal direction LDP of the pressure chamber 206 is perpendicular to a nozzle array direction along which a plurality of nozzles 204 are arrayed. The nozzle array direciton is indicated by arrow "NAD" in FIG. 17. FIG. 17 is a cross-sectional view of the head 1 of FIG. 16 along the nozzle array direction NAD corresponding to a line D-D in FIG. 16. The nozzle array direction NAD indicated in FIG. 1 has an inclination (angle) with the transverse direction TD of the common-supply main channel 56.

The head 1 according to the seventh embodiment includes a nozzle plate 201, a channel plate 202, and a diaphragm 203 as a wall that are laminated one on another and bonded to each other. The head 1 further includes a piezoelectric actuator 211 that displaces the diaphragm 203 and a common channel member 220.

The nozzle plate 201 includes the plurality of nozzles 204 to discharge a liquid. The channel plate 202 is a channel member that includes pressure chambers 206 (individual chambers), supply-side fluid restrictors 207, and supply-side inlets 208. The pressure chambers 206 communicate with the nozzles 204, respectively. The supply-side fluid restrictors 207 communicate with the pressure chambers 206 (individual chambers), respectively. The supply-side inlets 208 communicate with the supply-side fluid restrictors 207, respectively. The supply-side inlets 208 communicate with a common-supply channel 210 through a supply-side opening 209 formed in the diaphragm 31. The common-supply channel 210 is formed in the common channel member 220.

The diaphragm 203 forms a wall of the pressure chamber 206 of the channel plate 202. The diaphragm 203 has a two-layer structure (can be three or more layers) and includes a first layer 203A that forms a thin portion and a second layer 203B that forms a thick portion from the channel plate 202 side. The first layer 203A of the diaphragm 203 forms a deformable vibration portion 230 positioned corresponding to the pressure chambers 206 (individual chamber).

The head 1 includes a piezoelectric actuator 211 including an electromechanical transducer element as a driving device (actuator device or pressure generator) to deform a vibration portion 230 of the diaphragm 203 disposed at a fist side of the diaphragm 203 opposite a second side facing the pressure chambers 206 (individual chambers).

The piezoelectric actuator 211 includes piezoelectric members 212 bonded on a base 213. The piezoelectric members 212 are groove-processed by half-cut dicing so that each piezoelectric members 212 includes a desired number of pillar-shaped piezoelectric elements 212A and 212B that are arranged in certain intervals to have a comb shape.

The piezoelectric elements 212A of the piezoelectric member 212 are piezoelectric elements to be driven by application of drive waveforms and the piezoelectric elements 212B are supports to which no drive waveform is applied. However, all of the piezoelectric elements 212A and 212B may be piezoelectric elements to be driven by application of drive waveforms.

The piezoelectric element 212A is bonded to a convex portion 230*a* having an island-shaped thick portion on the vibration portion 230 of the diaphragm 203. The piezoelectric element 212B is bonded to a convex portion 230*b* that is a thick portion of the diaphragm 203.

The piezoelectric member 212 includes piezoelectric layers and internal electrodes alternately laminated on each other. Each internal electrode is pulled out to an end surface of the piezoelectric member 212 to form an external electrode. The external electrode is connected to a flexible wiring member 215.

The channel plate 202 includes recovery-side fluid restrictors 257, recovery-side individual channels 256, and recovery-side outlets 258. The recovery-side fluid restrictors 257, the recovery-side individual channels 256, and the recovery-side outlets 258 are formed along a surface direction of the channel plate 202, and communicate with the pressure chambers 206 (individual chambers). The recovery-side outlet 258 communicating with the common-recovery channel 250 formed by the common channel member 220 through the recovery-side opening 259 formed in the diaphragm 203.

Connection channels 205 connect the pressure chambers 206, nozzles 204, and recovery-side fluid restrictors 257, respectively. The connection channels 205 face the nozzles 204 respectively.

The common channel member 220 defines a common-supply channel 210 and a common-recovery channel 250. The common channel member 220 further includes a supply port 271 to supply the liquid from an external circulation path to the common-supply channel 210 and a recovery port 272 to recover the liquid to the external circulation path (see FIG. 18).

The common-supply channel 210 includes a first channel portion 210A arranged side-by-side with the common-recovery channel 250 in a direction perpendicular to the nozzle array direction NAD (in the longitudinal direction LDP of the pressure chamber 206). Further, the channel portion 210B, which is a part of the common-supply channel 210, is arranged above the first channel portion 210A and the common-recovery channel 250 in a gravity direction and is not aligned with the common-recovery channel 250 in the direction perpendicular to the nozzle array direction NAD (in the longitudinal direction LDP). The gravity direction is identical to the "discharge direction" as indicated by arrow in FIG. 2.

In the head 1 thus configured, for example, when a voltage lower than a reference potential is applied to the piezoelectric element 212A, the piezoelectric element 212A contracts. Accordingly, the vibration portion 230 of the diaphragm 203 moves upward in FIGS. 16 and 17 and the volume of the pressure chamber 206 increases, thus causing liquid to flow into the pressure chamber 206.

When the voltage applied to the piezoelectric element 212A is raised, the piezoelectric element 212A expands in a direction of lamination of the piezoelectric element 212A. The vibration portion 230 of the diaphragm 203 deforms in a direction toward the nozzle 204 and contracts the volume of the pressure chambers 206. As a result, the liquid in the pressure chambers 206 is squeezed out of the nozzle 204.

When the voltage applied to the piezoelectric element 212A is returned to the reference potential, the vibration portion 230 of the diaphragm 203 is returned to the initial position. Accordingly, the pressure chamber 206 expands to generate a negative pressure, thus replenishing liquid from the common-supply channel 210 into the pressure chamber 206. After the vibration of a meniscus surface of the liquid in the nozzle 204 decays to a stable state, the head 1 shifts to a next liquid discharge operation.

Further, the liquid not discharged from the nozzle 204 passes the nozzle 204 and is discharged to the common-recovery channel 250 through the recovery-side fluid restrictor 257, the recovery-side individual channel 256, the recovery-side outlet 258, and the recovery-side opening 259. Then, the liquid is supplied from the common-recovery channel 250 to the common-supply channel 210 again through an external circulation passage. Even when the liquid is not discharged from the nozzle 204, the liquid flows from the common-supply channel 210 to the common-recovery channel 250 and is again supplied to the common-supply channel 210 through the external circulation passage.

Note that the driving method of the head 1 is not limited to the above-described example (pull-push discharge). For example, pull discharge or push discharge may be performed in accordance with the way to apply a drive waveform.

Figure 18:
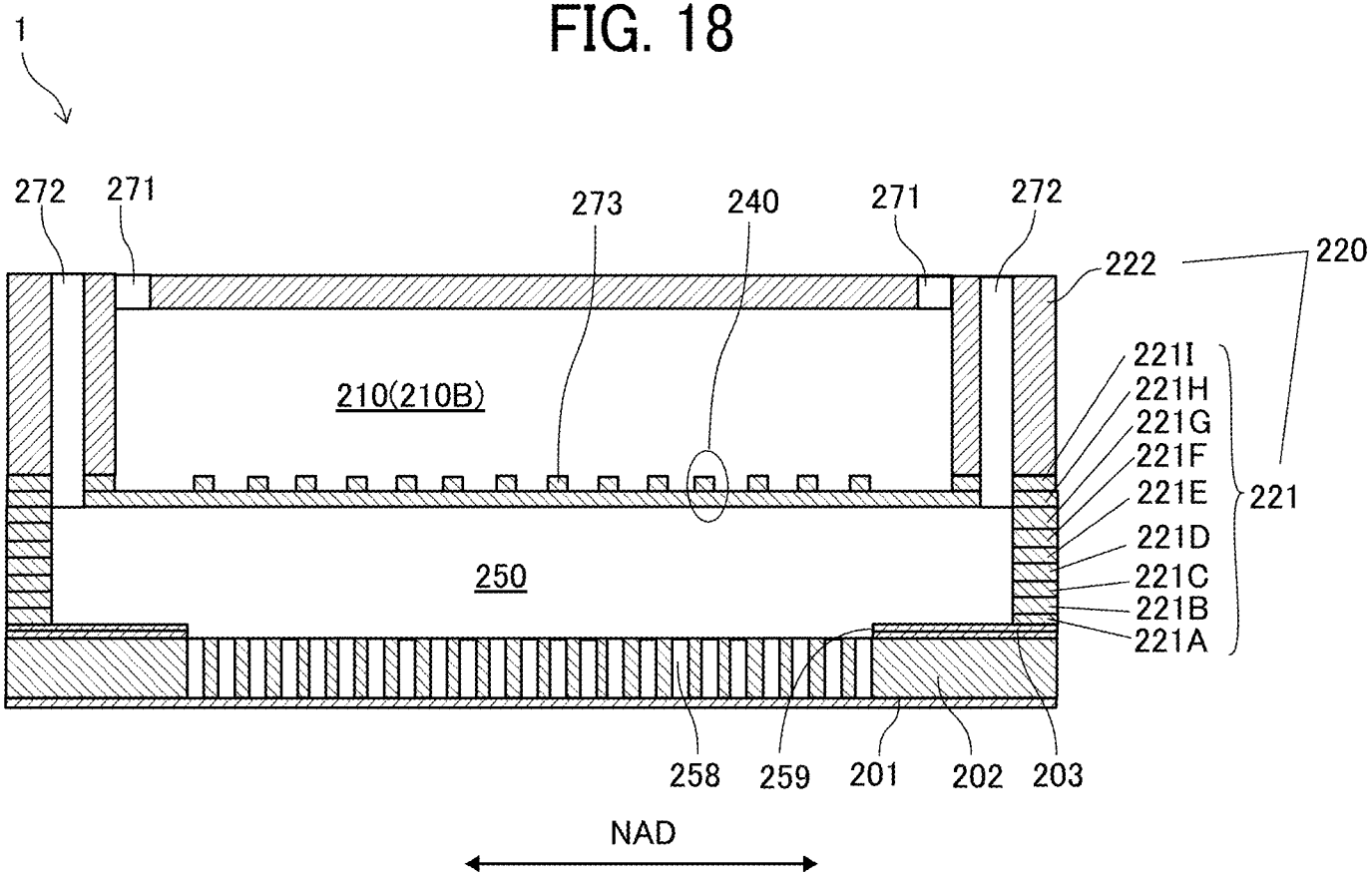
FIG. 18 is a cross-sectional view of the common channel member of the liquid discharge head along the nozzle array direction corresponding to a line E-E in FIG. 16.
Figure 19:
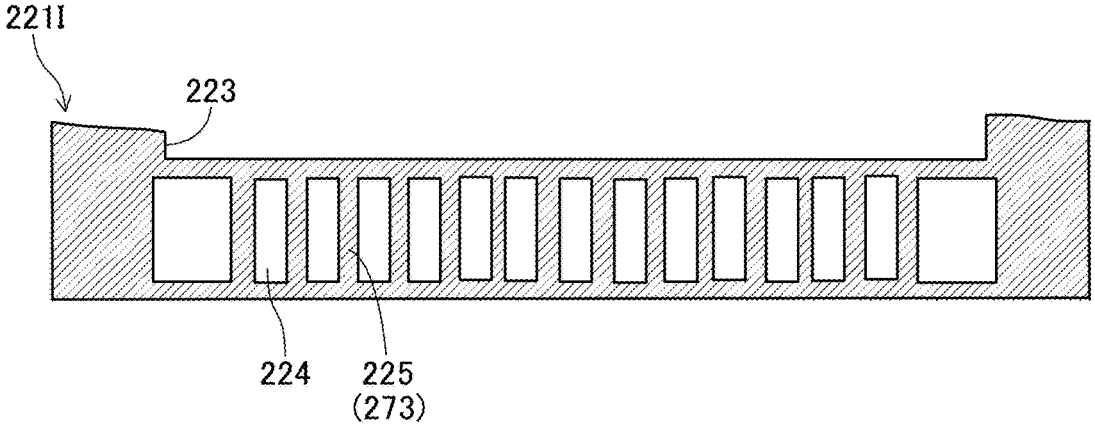
FIG. 19 is a plan view of a portion of a plate forming a bottom surface of the common-supply channel.

Next, a configuration of the common channel member 220 in the head according to the seventh embodiment is described with reference to FIGS. 18 and 19. FIG. 18 is a cross-sectional view of the head 1 of FIG. 16 along the nozzle array direction NAD corresponding to a line D-D in FIG. 16. FIG. 19 is a plan view of a portion of a plate forming a bottom surface of the common-supply channel 210.

The common channel member 220 includes a first common channel member 221 and a second common channel member 222. The first common channel member 221 includes a first channel portion 210A and the common-recovery channel 250. The second common channel member 222 includes a second channel portion 210B that is a part of the common-supply channel 210.

Further, the second common channel member 222 includes a supply port 271 communicating with the second channel portion 210B that is a part of the common-supply channel 210.

In the head 1 according to the seventh embodiment, the first common channel member 221 includes lamination of a plurality of plates 221A to 221I (plate-like members). In FIG. 18, nine plates 221A to 221I are laminated to form the first common channel member 221. The plates 221H and 222I among the plurality of plates 221A to 221I of the first common channel member 221 forms a partition wall 240 between the second channel portion 210B of the common-supply channel 210 and the common-recovery channel 250. The partition wall 240 forms a bottom surface of the second channel portion 210B.

The plate 221I disposed at the second channel portion 210B side is one of the plurality of plates 221H and 221I that forms the partition wall 240 between the second channel portion 210B of the common-supply channel 210 and the common-recovery channel 250. As illustrated in FIG. 19, a plurality of slits 224 are formed in the plate 221I at regions that becomes a bottom surface of the second channel portion 210B of the common-supply channel 210. The plate 221I includes a through-hole 223 that forms the first channel portion 210A that is a part of the common-supply channel 210.

Walls 225 formed between a plurality of slits 224 in the plate 221I forms the convex portions 273 as illustrated in FIGS. 18 and 19. That is, the plurality of slits 224 are arranged such that the walls 225 between the plurality of slits 224 forms the convex portions 273.

Thus, the plurality of convex portions 273 can be easily formed on a bottom surface of the second channel portion 210B of the common-supply channel 210.

Figure 20:
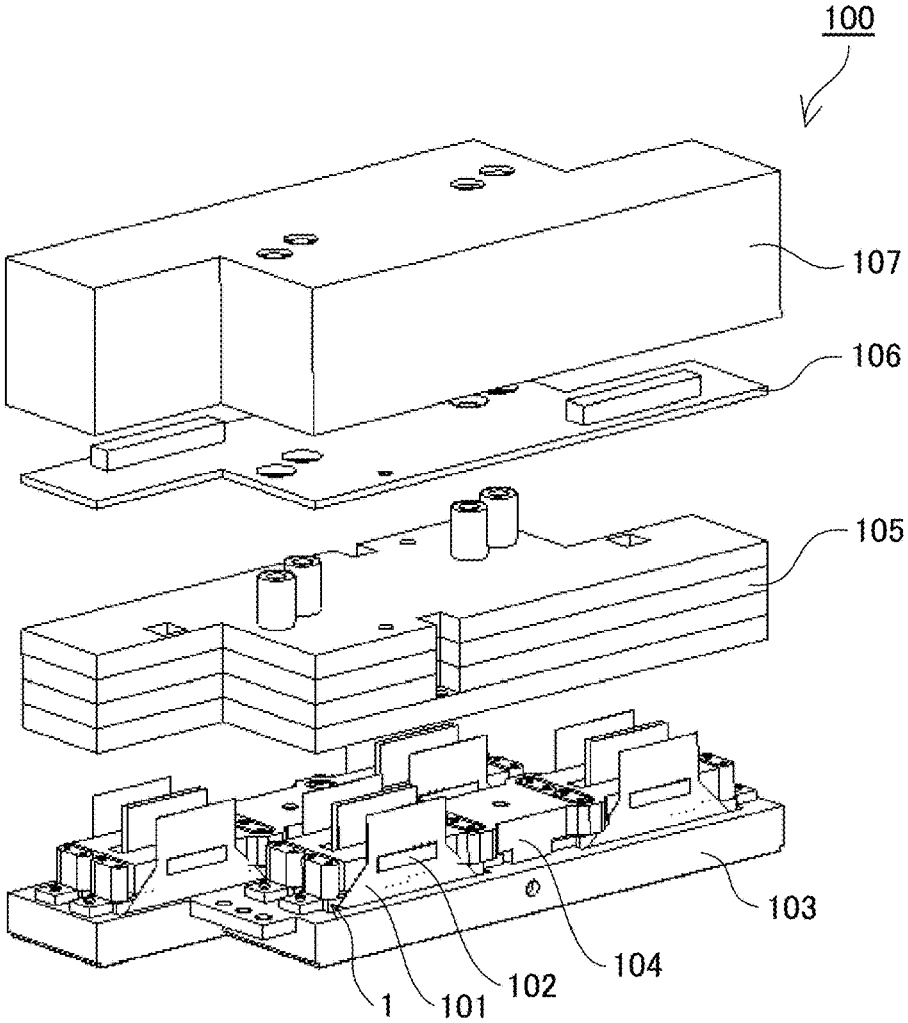
FIG. 20 is an exploded perspective view of a head module according to the present disclosure.
Figure 21:
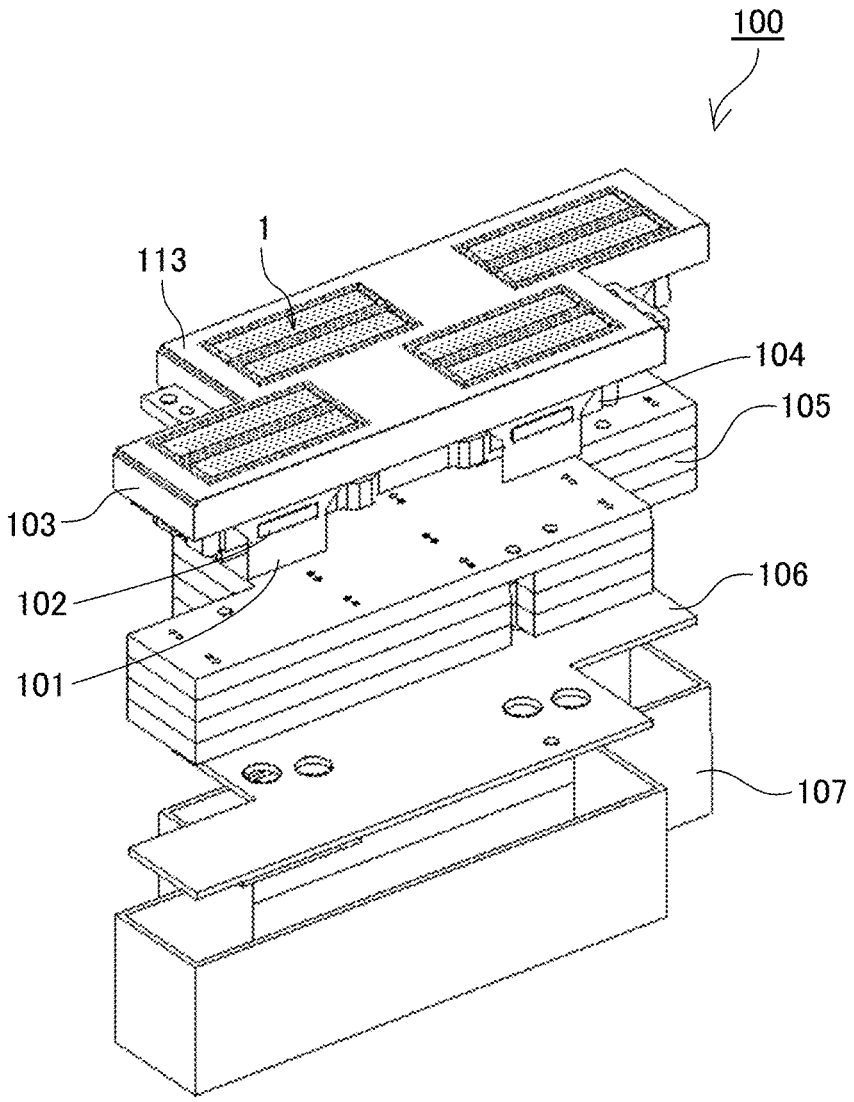
FIG. 21 is an exploded perspective view of the head module viewed from a nozzle surface side of the head module.

FIGS. 20 and 21 illustrate an example of a head module according to an embodiment of the present disclosure. FIG. 20 is an exploded perspective view of a head module 100. FIG. 21 is an exploded perspective view of the head module 100 viewed from a nozzle surface side of the head module 100.

The head module 100 includes a plurality of heads 1 as described above, a base 103 that holds the plurality of heads 1, and a cover 113 that serves as a nozzle cover of the plurality of heads 1.

Further, the head module 100 includes a heat radiator 104, a manifold 105 forming a channel to supply liquid to the plurality of heads 1, a printed circuit board 106 (PCB) connected to a flexible wiring 101, and a module case 107.

Figure 22:
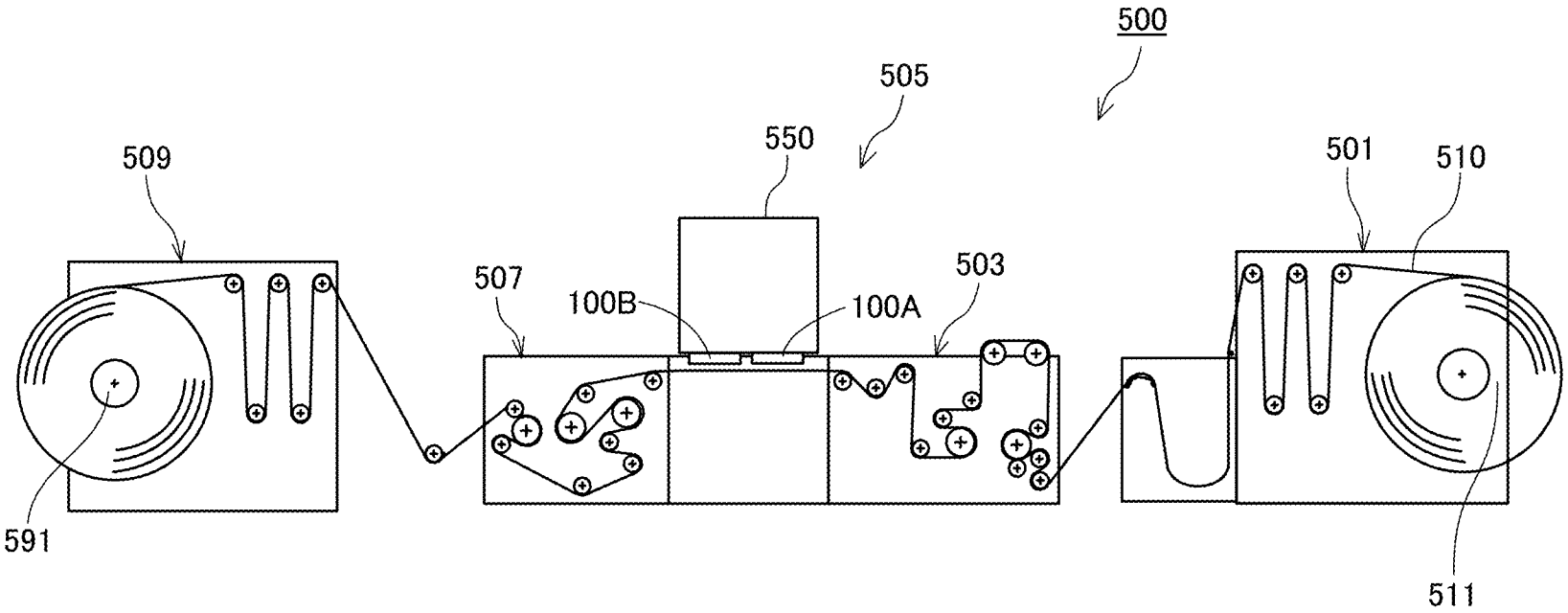
FIG. 22 is a schematic side view of a liquid discharge apparatus according to the present disclosure.
Figure 23:
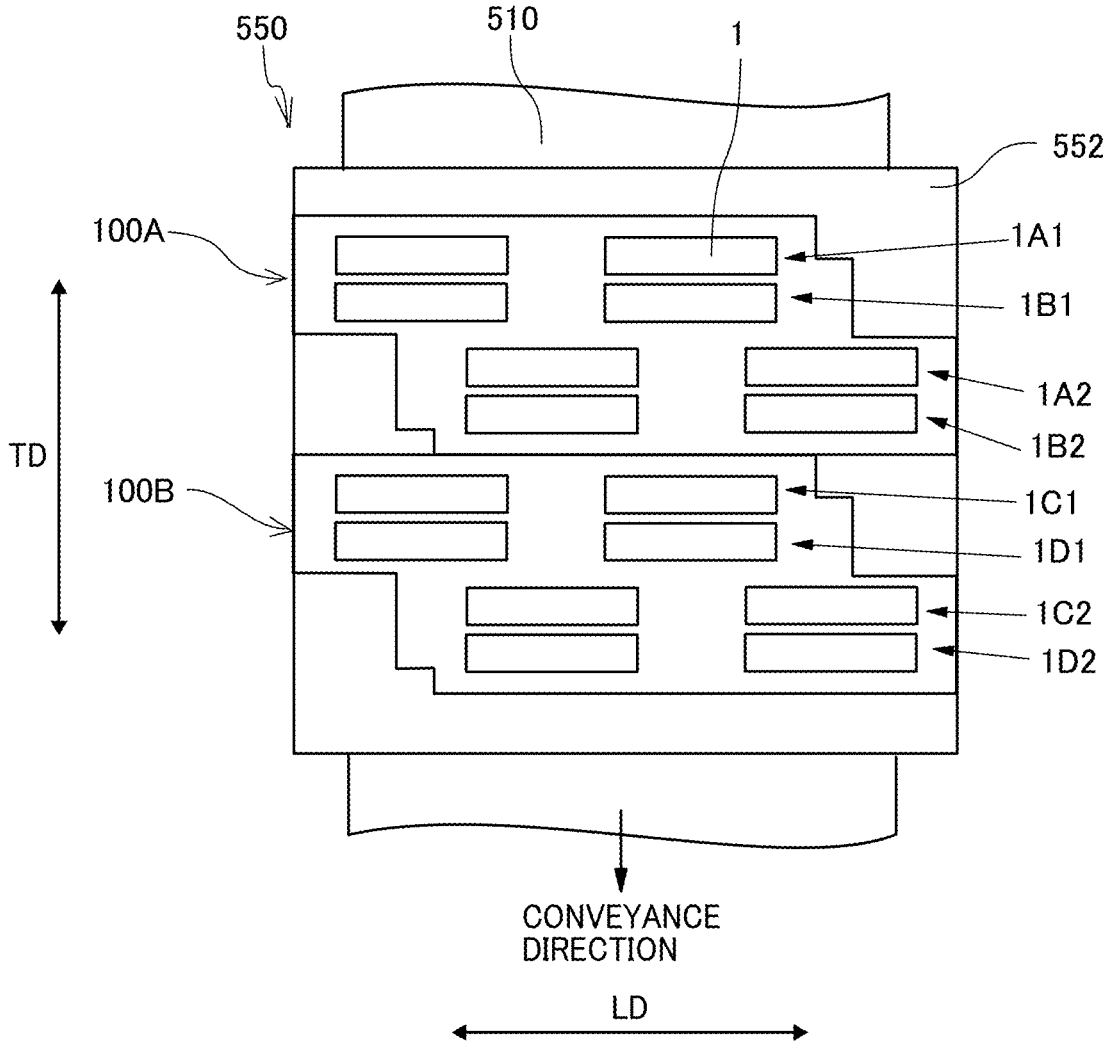
FIG. 23 is a plan view of a head device of the liquid discharge apparatus of FIG. 22.

FIGS. 22 and 23 illustrate an example of a liquid discharge apparatus according to the present disclosure. FIG. 22 is a side view of a liquid discharge apparatus according to the present disclosure. FIG. 23 is a plan view of a head unit 550 of the liquid discharge apparatus of FIG. 22 according to the present disclosure.

A printer 500 serving as the liquid discharge apparatus includes a feeder 501 to feed a continuous medium 510, such as a rolled sheet, a guide conveyor 503 to guide and convey the continuous medium 510, fed from the feeder 501, to a printing unit 505, the printing unit 505 to discharge a liquid onto the continuous medium 510 to form an image on the continuous medium 510, a drier unit 507 to dry the continuous medium 510, and an ejector 509 to eject the continuous medium 510.

The continuous medium 510 is fed from a winding roller 511 of the feeder 501, guided and conveyed with rollers of the feeder 501, the guide conveyor 503, the drier unit 507, and wound around a take-up roller 591 of the ejector 509.

The continuous medium 510 is conveyed by the printing unit 505 so as to face the head unit 550, and an image is printed by the liquid ejected from the head unit 550.

Here, as illustrated in FIG. 23, the head unit 550 includes two head modules 100A and 100B according to the present disclosure on a common base 552.

The head module 100A includes head arrays 1A1, 1B1, 1A2, and 1B2. Each of the head arrays 1A1, 1B1, 1A2, and 1B2 includes a plurality of heads 1 arranged in a direction perpendicular to a conveyance direction of the continuous medium 510. The direction perpendicular to the conveyance direction of the continuous medium 510 is also referred to as a "head array direction" indicated by arrow "HAD" in FIG. 23. The head module 100B includes head arrays 1C1, 1D1, 1C2, and 1D2.

Each of the head arrays 1C1, 1D1, 1C2, and 1D2 includes a plurality of heads 1 arranged in the head array direction HAD. The head 1 in each of the head arrays 1A1 and 1A2 of the head module 100A discharges liquid of the same color. Similarly, the head arrays 1B1 and 1B2 of the head module 100A are grouped as one set that discharge liquid of the same color. The head arrays 1C1 and 1C2 of the head module 100B are grouped as one set that discharge liquid of the same color. The head arrays 1D1 and 1D2 are grouped as one set to discharge liquid of the same color.

Figure 24:
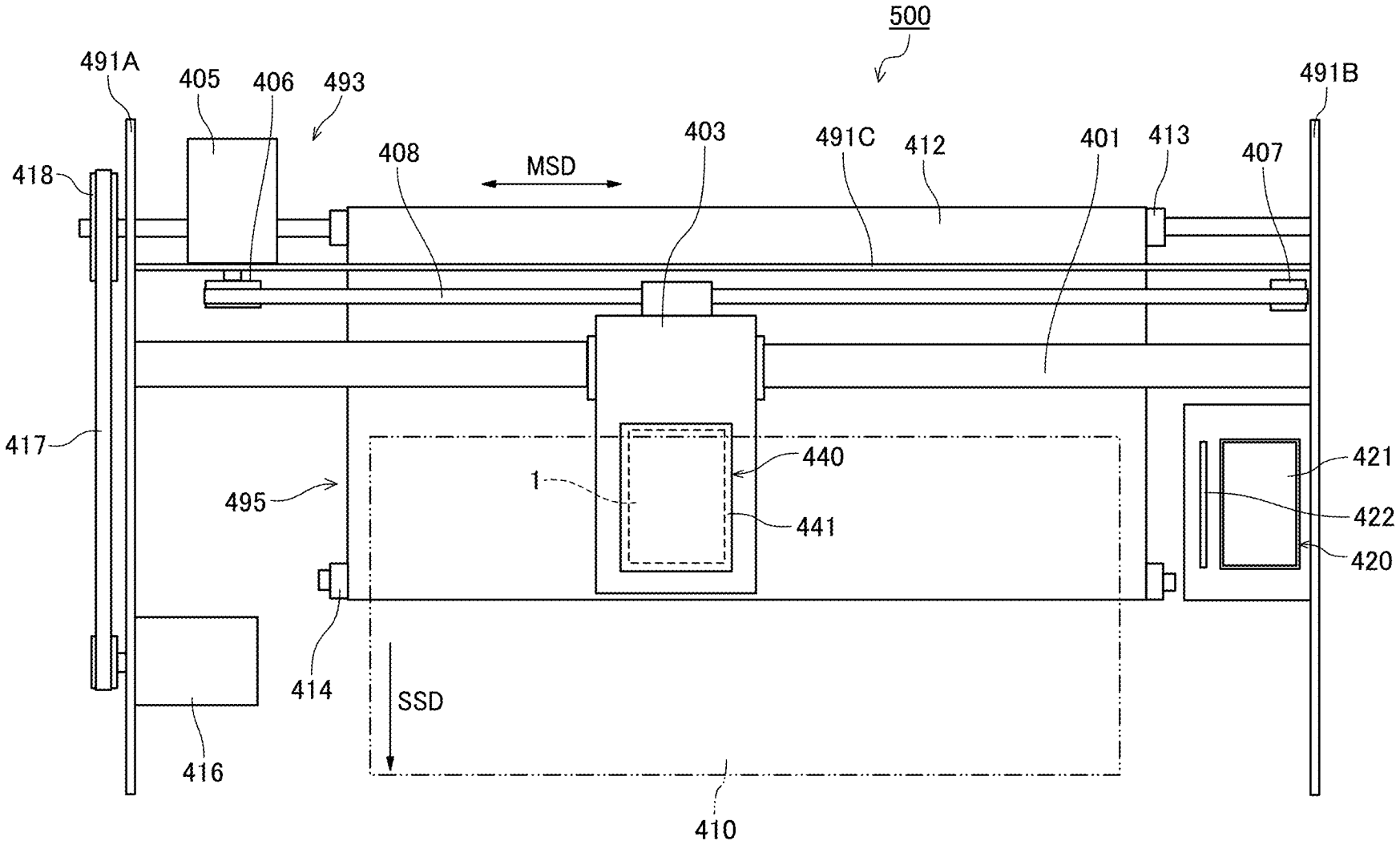
FIG. 24 is a plan view of a portion of a printer as a liquid discharge apparatus according to the present disclosure.
Figure 25:
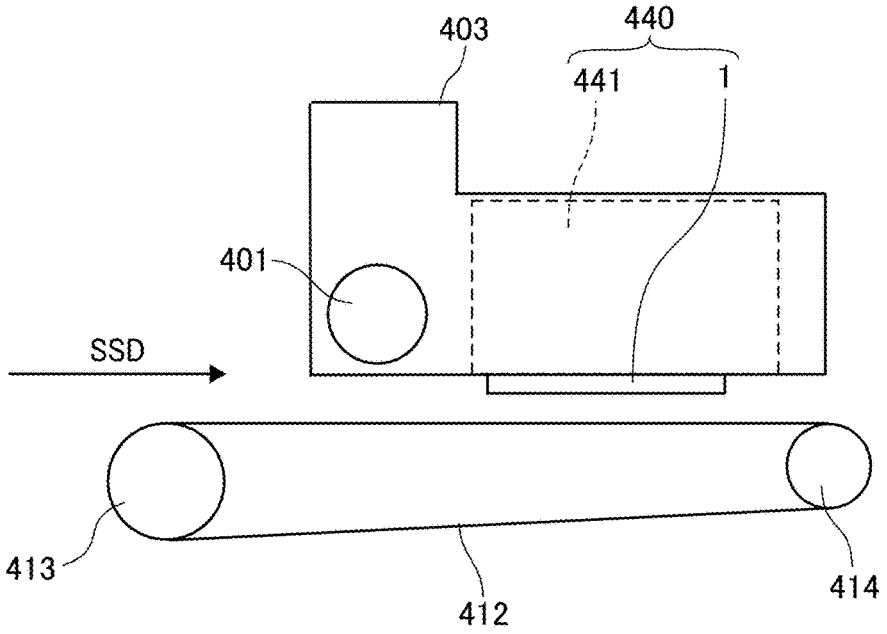
FIG. 25 is a schematic side view of a main portion of the liquid discharge apparatus.

Next, another example of a printer 500 serving as a liquid discharge apparatus according to the present disclosure is described with reference to FIGS. 24 and 25. FIG. 24 is a plan view of a portion of the printer 500. FIG. 25 is a side view of a portion of the printer 500 of FIG. 24.

The printer 500 is a serial type apparatus, and the carriage 403 is reciprocally moved in the main scanning direction MSD by the main scan moving unit 493. The main scanning moving unit 493 includes a guide 401, a main scanning motor 405, a timing belt 408, and the like. The guide 401 is bridged between a left-side plate 491A and a right-side plate 491B to moveably hold the carriage 403. The main scanning motor 405 reciprocally moves the carriage 403 in the main scanning direction MSD via the timing belt 408 bridged between a driving pulley 406 and a driven pulley 407.

The carriage 403 mounts a liquid discharge device 440. The head 1 according to the present disclosure and a head tank 441 forms the liquid discharge device 440 as a single unit. The head 1 of the liquid discharge device 440 discharges liquid of each color, for example, yellow (Y), cyan (C), magenta (M), and black (K). The head 1 includes a nozzle array including a plurality of nozzles 11 arrayed in a sub-scanning direction indicated by arrow "SSD" perpendicular to the main scanning direction indicated by arrow "MSD" in FIG. 24. The head 1 is mounted to the carriage 403 so that ink droplets are discharged downward.

The printer 500 includes a conveyor 495 to convey a sheet 410. The conveyor 495 includes a conveyance belt 412 as a conveyor and a sub-scanning motor 416 to drive the conveyance belt 412.

The conveyance belt 412 attracts the sheet 410 and conveys the sheet 410 at a position facing the head 1. The conveyance belt 412 is an endless belt and is stretched between a conveyance roller 413 and a tension roller 414. Attraction of the sheet 410 to the conveyance belt 412 may be applied by electrostatic adsorption, air suction, or the like.

The conveyance belt 412 cyclically rotates in the sub-scanning direction SSD as the conveyance roller 413 is rotationally driven by the sub-scanning motor 416 via the timing belt 417 and the timing pulley 418.

At one side in the main scanning direction MSD of the carriage 403, a maintenance unit 420 to maintain the head 1 in good condition is disposed on a lateral side of the conveyance belt 412.

The maintenance unit 420 includes, for example, a cap 421 to cap the nozzle surface of the head 1 and a wiper 422 to wipe the nozzle surface of the head 1.

The main scan moving unit 493, the maintenance unit 420, and the conveyor 495 are mounted to a housing that includes a left-side plate 491A, a right-side plate 491B, and a rear-side plate 491C.

In the printer 500 thus configured, the sheet 410 is conveyed on and attracted to the conveyance belt 412 and is conveyed in the sub-scanning direction SSD by the cyclic rotation of the conveyance belt 412.

The head 1 is driven in response to image signals while the carriage 403 moves in the main scanning direction MSD, to discharge liquid to the sheet 410 stopped, thus forming an image on the sheet 410.

Figure 26:
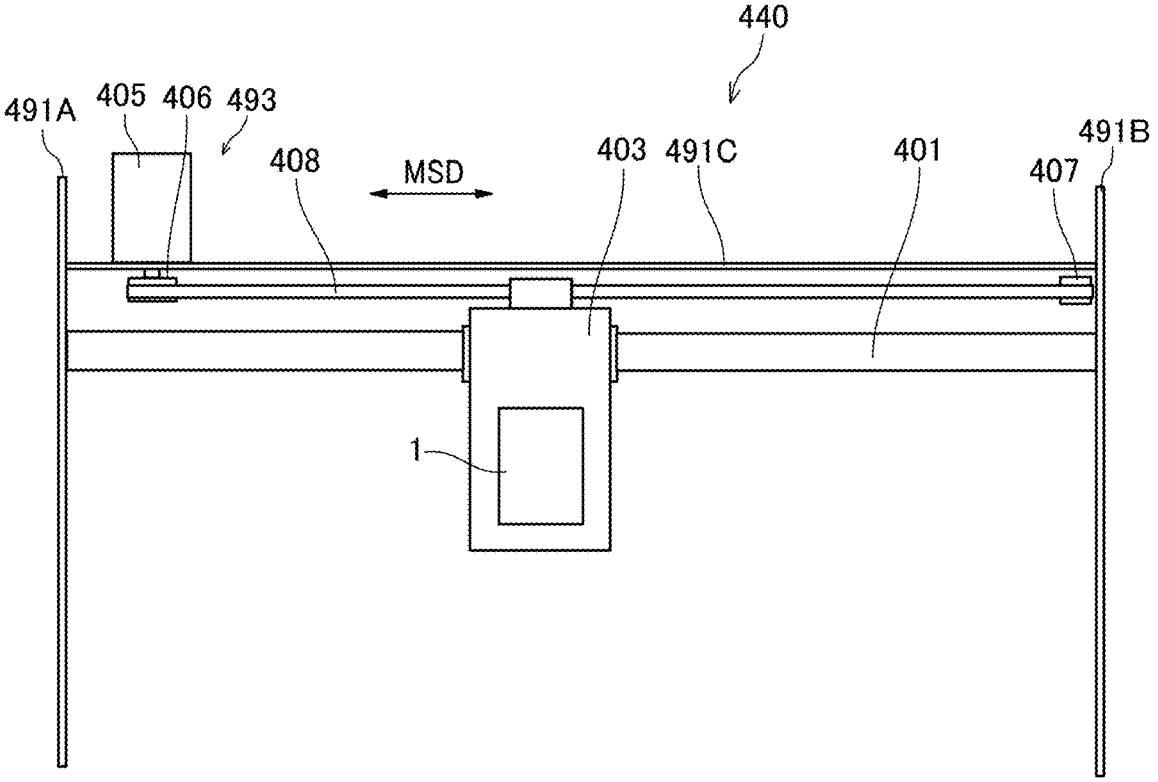
FIG. 26 is a plan view of a portion of another example of a liquid discharge device.

Next, the liquid discharge device 440 according to another embodiment of the present disclosure is described with reference to FIG. 26. FIG. 26 is a plan view of a portion of another example of the liquid discharge device 440.

The liquid discharge device 440 includes a housing, the main scan moving unit 493, the carriage 403, and the head 1 among components of the printer 500 (liquid discharge apparatus). The left-side plate 491A, the right-side plate 491B, and the rear-side plate 491C constitute the housing.

Note that, in the liquid discharge device 440, the maintenance unit 420 described above may be mounted on, for example, the right-side plate 491B.

Figure 27:
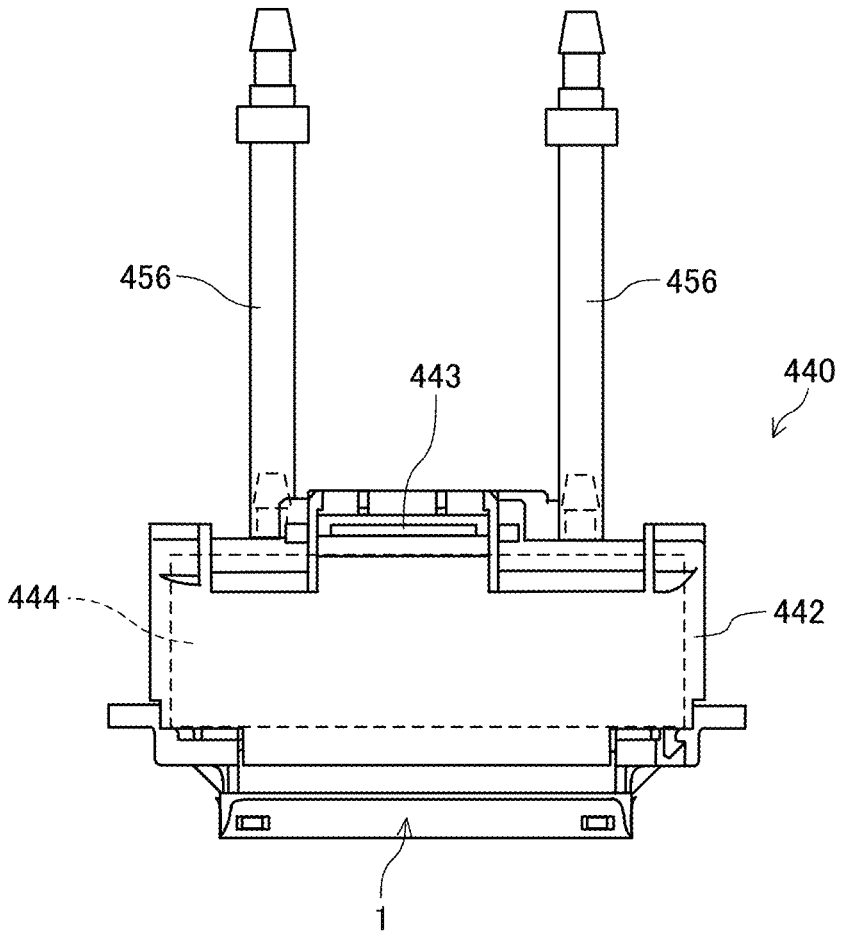
FIG. 27 is a front view of the liquid discharge device according to still another embodiment of the present disclosure.

Next, still another example of the liquid discharge device 440 according to the present disclosure is described with reference to FIG. 27. FIG. 27 is a front view of still another example of the liquid discharge device 440.

The liquid discharge device 440 includes the head 1, to which a channel part 444 is attached, and a tube 456 connected to the channel part 444.

Further, the channel part 444 is disposed inside a cover 442. Instead of the channel part 444, the liquid discharge device 440 may include a head tank 441. A connector 443 electrically connected with the head 1 is provided on an upper part of the channel part 444.

In the present disclosure, discharged liquid is not limited to a particular liquid as long as the liquid has a viscosity or surface tension to be discharged from a head (liquid discharge head). However, preferably, the viscosity of the liquid is not greater than 30 mPa·s under ordinary temperature and ordinary pressure or by heating or cooling.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant.

Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source to generate energy to discharge liquid include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

The "liquid discharge device" is an assembly of parts relating to liquid discharge. The term "liquid discharge device" represents a structure including the head and a functional part(s) or mechanism combined to the head to form a single unit. For example, the "liquid discharge device" includes a combination of the head with at least one of a head tank, a carriage, a supply unit, a maintenance unit, a main scan moving unit, and a liquid circulation apparatus.

Here, examples of the "single unit" include a combination in which the head and a functional part(s) or unit(s) are secured to each other through, e.g., fastening, bonding, or engaging, and a combination in which one of the head and a functional part(s) or unit(s) is movably held by another. The head may be detachably attached to the functional part(s) or unit(s) s each other.

For example, the head and the head tank may form the liquid discharge device as a single unit. Alternatively, the head and the head tank coupled (connected) with a tube or the like may form the liquid discharge device as a single unit. Here, a unit including a filter may further be added to a portion between the head tank and the head.

In another example, the head and the carriage may form the liquid discharge device as a single unit.

In still another example, the liquid discharge device includes the head movably held by a guide that forms part of a main scan moving unit, so that the head and the main scan moving unit form a single unit. The liquid discharge device may include the head, the carriage, and the main scan moving unit that form a single unit.

In still another example, a cap that forms part of a maintenance unit may be secured to the carriage mounting the head so that the head, the carriage, and the maintenance unit form a single unit to form the liquid discharge device.

Further, in another example, the liquid discharge device includes tubes connected to the head to which the head tank or the channel member is attached so that the head and a supply unit form a single unit. Liquid is supplied from a liquid reservoir source to the head via the tube.

The main scan moving unit may be a guide only. The supply unit may be a tube(s) only or a loading unit only.

In another example, the "liquid discharge device" may be a single unit in which the head and other functional parts are combined with each other. The "liquid discharge device" includes a head module including the above-described head, and a head device in which the above-described functional components and mechanisms are combined to form a single unit.

The term "liquid discharge apparatus" used herein also represents an apparatus including the head, the liquid discharge device, the head module, and the head device to discharge liquid by driving the head. The liquid discharge apparatus may be, for example, an apparatus capable of discharging liquid to a material to which liquid can adhere or an apparatus to discharge liquid toward gas or into liquid.

The "liquid discharge apparatus" may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The "liquid discharge apparatus" is not limited to an apparatus to discharge liquid to visualize meaningful images, such as letters or figures. For example, the liquid discharge apparatus may be an apparatus to form arbitrary images, such as arbitrary patterns, or fabricate three-dimensional images.

The above-described term "material on which liquid can be adhered" represents a material on which liquid is at least temporarily adhered, a material on which liquid is adhered and fixed, or a material into which liquid is adhered to permeate. Examples of the "material on which liquid can be adhered" include recording media such as a paper sheet, recording paper, and a recording sheet of paper, film, and cloth, electronic components such as an electronic substrate and a piezoelectric element, and media such as a powder layer, an organ model, and a testing cell. The "material on which liquid can be adhered" includes any material on which liquid adheres unless particularly limited.

Examples of the "material on which liquid can be adhered" include any materials on which liquid can be adhered even temporarily, such as paper, thread, fiber, fabric, leather, metal, plastic, glass, wood, and ceramic.

The "liquid discharge apparatus" may be an apparatus to relatively move the head and a material on which liquid can be adhered. However, the liquid discharge apparatus is not limited to such an apparatus. For example, the liquid discharge apparatus may be a serial head apparatus that moves the head or a line head apparatus that does not move the head.

Examples of the "liquid discharge apparatus" further include a treatment liquid coating apparatus to discharge a treatment liquid to a sheet to coat the treatment liquid on the surface of the sheet to reform the sheet surface, and an injection granulation apparatus in which a composition liquid including raw materials dispersed in a solution is injected through nozzles to granulate fine particles of the raw materials.

The terms "image formation", "recording", "printing", "image printing", and "fabricating" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge head comprising:

a plurality of nozzles, to discharge a liquid in a gravity direction;

a plurality of pressure chambers communicating with the plurality of nozzles, respectively;

a common channel, communicating with each of the plurality of pressure chambers, the common channel including a top surface and a bottom surface, disposed below the top surface in the gravity direction; and a plurality of convex portions formed within the common channel, on the bottom surface of the common channel, the plurality of convex portions protruding upward in a direction from the bottom surface to the top surface.

2. The liquid discharge head according to claim 1, wherein the common channel includes:

a common-supply channel connected to an upstream of the plurality of pressure chambers in a direction of liquid flow from the common-supply channel to the plurality of pressure chambers; and a common-recovery channel connected to a downstream of the plurality of pressure chambers in the direction of liquid flow, and the plurality of convex portions is formed on a bottom surface of the common-supply channel disposed below a top surface of the common-supply channel in the gravity direction.

3. The liquid discharge head according to claim 2, wherein the common-supply channel includes:

a first channel portion arranged side-by-side with the common-recovery channel in a longitudinal direction of the plurality of the pressure chambers;

a second channel portion disposed above the first channel portion and the common-recovery channel in the gravity direction; and a partition wall partitioning the second channel portion of the common-supply channel and the common-recovery channel, the partition wall forms a bottom surface of the second channel portion, and the plurality of convex portions is formed on the bottom surface of the second channel portion.

4. The liquid discharge head according to claim 3, further comprising a plate configured to form the partition wall, wherein the plate includes:

a plurality of slits arranged in a direction orthogonal to the longitudinal direction of the plurality of the pressure chambers, and a plurality of walls formed between the plurality of slits, the plurality of walls forms the plurality of convex portions facing the second channel portion.

5. The liquid discharge head according to claim 2, wherein the common-supply channel includes:

a plurality of common-supply branch channels communicating with two or more of the plurality of pressure chambers; and a common-supply main channel communicating with each of the common-supply branch channels, and wherein the plurality of convex portions are formed on a bottom surface of the common-supply main channel disposed below a top surface of the common-supply main channel in the gravity direction.

6. The liquid discharge head according to claim 5, further comprising:

a supply port connected to one end of the common-supply main channel in a longitudinal direction of the common-supply main channel, the supply port configured to supply the liquid to the common-supply main channel, wherein a density of arrangement of the plurality of convex portions in a portion away from the supply port is larger than a density of arrangement of the plurality of convex portions in a portion near the supply port.

7. The liquid discharge head according to claim 5, wherein the common-supply main channel includes the plurality of convex portions at portions between connections at which the common-supply main channel is connected to the plurality of common-supply branch channels.

8. The liquid discharge head according to claim 5, wherein a height of each of the plurality of convex portions is equal to or less than half of a height of the common-supply main channel.

9. The liquid discharge head according to claim 5, wherein a width of each of the plurality of convex portions is equal to or less than half of a width of the common-supply main channel in a transverse direction of the common-supply main channel.

10. The liquid discharge head according to claim 5, wherein each of the plurality of convex portions is arranged in a central part in a transverse direction of the common-supply main channel.

11. The liquid discharge head according to claim 5, wherein one end of each of the plurality of convex portions contacts a first side wall of the common-supply main channel in a transverse direction of the common-supply main channel, another end of each of the plurality of convex portions separates from a second side wall disposed opposite the first side wall, and the second side wall is connected to each of the plurality of common-supply branch channels.

12. The liquid discharge head according to claim 5, wherein each of the plurality of convex portions includes:

a first part contacting a first side wall of the common-supply main channel in a transverse direction of the common-supply main channel; and a second part contacting a second side wall of the common-supply main channel opposite the first side wall with a space between the first part and the second part.

13. The liquid discharge head according to claim 1, wherein the common channel includes:

a common-supply channel connected to an upstream of the plurality of pressure chambers in a direction of liquid flow from the common-supply channel to the plurality of pressure chambers; and a common-recovery channel connected to a downstream of the plurality of pressure chambers in the direction of liquid flow, and the plurality of convex portions is formed on a bottom surface of the common-recovery channel disposed below a top surface of the common-recovery channel in the gravity direction.

14. The liquid discharge head according to claim 13, wherein the common-recovery channel includes:

a plurality of common-recovery branch channels communicating with two or more of the plurality of pressure chambers; and a common-recovery main channel communicating with each of the common-recovery branch channels, the plurality of convex portions is formed on a bottom surface of the common-recovery main channel disposed below a top surface of the common-recovery main channel in the gravity direction.

15. The liquid discharge head according to claim 14, wherein the common-recovery main channel includes the plurality of convex portions at portions between connections at which the common-recovery main channel is connected to the plurality of common-recovery branch channels.

16. The liquid discharge head according to claim 14, wherein a height of each of the plurality of convex portions is equal to or less than half of a height of the common-recovery main channel.

17. The liquid discharge head according to claim 14, wherein a width of each of the plurality of convex portions is equal to or less than half of a width of the common-recovery main channel in a transverse direction of the common-recovery main channel.

18. A liquid discharge device comprising a plurality of liquid discharge heads including the liquid discharge head according to claim 1.

19. The liquid discharge device according to claim 18, wherein the liquid discharge head is integrated with at least one of:

a head tank configured to store the liquid to be supplied to the liquid discharge head, a carriage on which the liquid discharge head is mounted, a supply unit configured to supply the liquid to the liquid discharge head, a recovery device configured to maintain the liquid discharge head, and a main scan moving unit configured to move the liquid discharge head in a main scanning direction.

20. A liquid discharge apparatus comprising the liquid discharge device according to claim 18.

* * * * *